US011179615B1

(12) United States Patent
Lagree

(10) Patent No.: US 11,179,615 B1
(45) **Date of Patent: *Nov. 23, 2021**

(54) EXERCISE MACHINE RAIL SYSTEM

(71) Applicant: Lagree Technologies, Inc., Burbank, CA (US)

(72) Inventor: Sebastien Anthony Louis Lagree, Burbank, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 4 days.

This patent is subject to a terminal disclaimer.

(21) Appl. No.: 16/915,189

(22) Filed: Jun. 29, 2020

Related U.S. Application Data

(63) Continuation of application No. 16/186,749, filed on Nov. 12, 2018, now Pat. No. 10,695,645, which is a (Continued)

(51) Int. Cl.
*A63B 71/00* (2006.01)
*A63B 21/02* (2006.01)

(Continued)

(52) U.S. Cl.
CPC .... *A63B 71/0054* (2013.01); *A63B 21/00061* (2013.01); *A63B 21/023* (2013.01);

(Continued)

(58) Field of Classification Search
CPC ..... A63B 71/0054; A63B 2071/009; A63B 21/4031; A63B 21/4035; A63B 21/00061; A63B 21/02; A63B 21/023; A63B 21/0428; A63B 21/055; A63B 21/151; A63B 21/154; A63B 23/0222; A63B 2208/0219

See application file for complete search history.

(56) References Cited

U.S. PATENT DOCUMENTS 1,621,477 A 8/1925 Pilates
3,589,720 A * 6/1971 Agamian ..... A63B 23/00 482/114

(Continued)

FOREIGN PATENT DOCUMENTS

WO 2004096376 A1 11/2004

OTHER PUBLICATIONS http://www.maximfitness.net/group-fitness/core-pilot; Core Pilot Exercise Machine by Maxim Strength Fitness; Received and Printed Jun. 16, 2015.

(Continued)

*Primary Examiner* — Garrett K Atkinson
(74) *Attorney, Agent, or Firm* — Neustel Law Offices

(57) ABSTRACT

An exercise machine rail system for improved exerciser mounting and dismounting, improved functional ergonomics, and reduced risk of exerciser injury when using an exercise machine. The exercise machine rail system generally includes either two rails in close relationship which are linked together via connectors or a singular rail. Bias members are disclosed as either extending along either outer side of the rails, internally to the rail, or underneath the rail. Due to the narrow nature of the rails used by the present invention, an exerciser is able to mount and dismount the exercise machine easily and efficiently.

30 Claims, 16 Drawing Sheets

Related U.S. Application Data continuation of application No. 15/973,332, filed on May 7, 2018, now Pat. No. 10,124,232, which is a continuation of application No. 15/722,700, filed on Oct. 2, 2017, now Pat. No. 9,962,592, which is a continuation of application No. 15/442,693, filed on Feb. 26, 2017, now Pat. No. 9,776,062, which is a continuation of application No. 14/742,031, filed on Jun. 17, 2015, now Pat. No. 9,579,555.

(60) Provisional application No. 62/013,036, filed on Jun. 17, 2014.

(51) Int. Cl.
*A63B 21/055* (2006.01)
*A63B 21/00* (2006.01)
*A63B 21/04* (2006.01)
*A63B 23/02* (2006.01)

(52) U.S. Cl.
CPC ..... *A63B 21/0428* (2013.01); *A63B 21/055* (2013.01); *A63B 21/151* (2013.01); *A63B 21/154* (2013.01); *A63B 21/4031* (2015.10); *A63B 21/4035* (2015.10); *A63B 21/4045* (2015.10); *A63B 23/0222* (2013.01); *A63B 2208/0219* (2013.01)

(56) References Cited

U.S. PATENT DOCUMENTS 3,746,338 A * 7/1973 Proctor ..... A63B 21/4045 482/101
3,770,267 A 11/1973 McCarthy
4,111,417 A * 9/1978 Gardner ..... A63B 21/05 482/128
4,239,212 A 12/1980 Hickey
4,541,627 A * 9/1985 MacLean ..... A63B 22/0076 482/112
4,650,184 A * 3/1987 Brebner ..... A63B 69/18 482/71
4,695,050 A * 9/1987 Smith ..... A63B 22/0076 482/73
4,709,918 A * 12/1987 Grinblat ..... A63B 21/012 482/118
4,736,944 A 4/1988 Johnson
4,756,523 A * 7/1988 Rasmussen ..... A63B 22/0076 188/67
4,759,540 A 7/1988 Yu
4,798,378 A 1/1989 Jones
4,865,317 A * 9/1989 Hickey ..... A63B 21/05 482/126
4,867,447 A 9/1989 Johnson
4,915,377 A * 4/1990 Malnke ..... A63B 21/06 482/138
5,064,189 A * 11/1991 Shiuh-Shinn ..... A63B 21/027 482/72
5,066,005 A * 11/1991 Luecke ..... A63B 22/0087 482/96
5,072,929 A * 12/1991 Peterson ..... A63B 22/0076 482/72
5,094,446 A 3/1992 Wiedner
5,108,093 A * 4/1992 Watterson ..... A63B 22/0012 482/112
5,263,913 A 11/1993 Boren
5,295,931 A 3/1994 Dreibelbis
5,295,935 A * 3/1994 Wang ..... A63B 21/0552 482/123
D362,700 S 9/1995 Breibart
5,503,609 A * 4/1996 Bull ..... A63B 23/0488 482/70
D382,319 S 8/1997 Gerschefske
5,681,249 A 10/1997 Endelman
5,885,197 A 3/1999 Barton
5,967,955 A 10/1999 Westfall
6,071,217 A * 6/2000 Barnett ..... A63B 21/0552 482/121
6,149,554 A 11/2000 Ferguson
6,179,753 B1 1/2001 Barker
6,280,366 B1 * 8/2001 Hsieh ..... A63B 22/0012 482/130
6,390,956 B1 5/2002 Seelye
6,440,045 B1 * 8/2002 Gaston ..... A63B 21/012 482/140
6,527,685 B2 * 3/2003 Endelman ..... A63B 21/023 482/121
6,634,996 B2 * 10/2003 Jacobsen ..... A63B 21/068 482/96
6,786,850 B2 * 9/2004 Nizamuddin ..... A63B 21/157 482/51
6,817,968 B2 * 11/2004 Galbraith ..... A63B 21/0552 482/121
6,981,932 B1 * 1/2006 Huang ..... A63B 21/00072 482/121
7,090,621 B2 * 8/2006 Loane ..... A63B 21/0552 482/51
7,163,500 B2 1/2007 Endelman
7,294,098 B2 * 11/2007 Barnard ..... A63B 22/0007 482/121
7,419,459 B2 * 9/2008 Van Straaten ..... A63B 22/14 482/146
7,438,673 B1 * 10/2008 Jones ..... A63B 22/203 482/51
7,654,941 B2 * 2/2010 Lacher ..... A63B 69/004 482/98
7,803,095 B1 * 9/2010 LaGree ..... A63B 22/0012 482/140
7,806,805 B2 * 10/2010 Barufka ..... A63B 21/068 482/5
7,931,570 B2 4/2011 Hoffman
7,967,736 B2 * 6/2011 D'Silva ..... A63B 22/0007 482/121
8,430,800 B2 * 4/2013 Nolan ..... A63B 21/023 482/130
8,500,611 B2 * 8/2013 Hoffman ..... A63B 69/0022 482/123
8,641,585 B2 * 2/2014 LaGree ..... A63B 22/0087 482/94
8,721,511 B2 * 5/2014 Endelman ..... A63B 21/156 482/142
8,834,332 B2 * 9/2014 Campanaro ..... A63B 21/00072 482/142
8,894,551 B2 * 11/2014 Kerdjoudj ..... A63B 23/0423 482/70
8,961,373 B2 * 2/2015 Halver ..... A63B 69/0022 482/51
9,022,909 B2 * 5/2015 Kermath ..... A63B 22/0089 482/133
9,028,374 B1 5/2015 Brady
9,079,071 B2 * 7/2015 Allain ..... A63B 21/4045
9,180,332 B1 * 11/2015 Tenorio ..... A63B 21/4045
9,289,645 B2 * 3/2016 Masterson ..... A63B 21/023
9,517,375 B2 12/2016 Lagree
9,579,555 B2 2/2017 Lagree
9,776,062 B2 10/2017 Lagree
9,962,592 B2 5/2018 Lagree
10,124,232 B2 11/2018 Lagree
10,279,207 B2 5/2019 Lagree
10,695,645 B1 6/2020 Lagree
2001/0056011 A1 12/2001 Endelman
2002/0058573 A1 * 5/2002 Endelman ..... A63B 21/055 482/142
2003/0119635 A1 6/2003 Arbuckle
2004/0009849 A1 * 1/2004 Galbraith ..... A63B 23/03583 482/72
2005/0130810 A1 6/2005 Sands
2005/0164856 A1 7/2005 Parmater
2006/0046914 A1 3/2006 Endelman
2006/0183606 A1 8/2006 Parmater
2006/0199712 A1 9/2006 Barnard

(56) References Cited

U.S. PATENT DOCUMENTS

| | | | | |
|---|---|---|---|---|
| 2006/0217239 | A1 | 9/2006 | Liao | |
| 2007/0293376 | A1 | 12/2007 | Tsai | |
| 2008/0070765 | A1 | 3/2008 | Brown | |
| 2008/0248935 | A1 | 10/2008 | Solow | |
| 2010/0227748 | A1 | 9/2010 | Campanaro | |
| 2011/0143898 | A1 | 6/2011 | Trees | |
| 2011/0152036 | A1* | 6/2011 | Halver | A63B 22/0046 482/51 |
| 2011/0166002 | A1 | 7/2011 | Savsek | |
| 2011/0172069 | A1 | 7/2011 | Gerschefske | |
| 2012/0277079 | A1 | 11/2012 | Allain | |
| 2012/0295771 | A1 | 11/2012 | Lagree | |
| 2014/0011645 | A1 | 1/2014 | Johnson | |
| 2014/0011647 | A1 | 1/2014 | Lalaoua | |
| 2014/0088466 | A1 | 3/2014 | Hansen | |
| 2014/0100089 | A1 | 4/2014 | Kermath | |
| 2014/0121076 | A1 | 5/2014 | Lagree | |
| 2014/0121078 | A1 | 5/2014 | Lagree | |
| 2014/0121079 | A1 | 5/2014 | Lagree | |
| 2014/0141948 | A1 | 5/2014 | Aronson | |
| 2015/0024914 | A1 | 1/2015 | Lagree | |
| 2015/0057127 | A1 | 2/2015 | Lagree | |
| 2015/0065318 | A1 | 3/2015 | Lagree | |
| 2015/0072841 | A1 | 3/2015 | Lagree | |
| 2015/0141204 | A1 | 5/2015 | Lagree | |
| 2015/0246258 | A1* | 9/2015 | Hockridge | A63B 23/03541 482/99 |
| 2015/0246263 | A1 | 9/2015 | Campanaro | |
| 2019/0255375 | A1 | 8/2019 | Lagree | |

OTHER PUBLICATIONS https://www youtube com/watch?v=6hf58ifB3_l; Core Pilot Exergenics Isokinetics Video from YouTube; Feb. 25, 2010; Screenshots of Relevant Prior Art; Printed Jun. 17, 2015.

U.S. Non-Final Rejection Issued from USPTO for U.S. Published Application US2020/0376359 A1; dated Nov. 19, 2020.

* cited by examiner

EXERCISE MACHINE RAIL SYSTEM

CROSS REFERENCE TO RELATED APPLICATIONS

The present application is a continuation of U.S. application Ser. No. 16/186,749 filed on Nov. 12, 2018 which issues as U.S. Pat. No. 10,695,645 on Jun. 30, 2020, which is a continuation of U.S. application Ser. No. 15/973,332 filed on May 7, 2018 now issued as U.S. Pat. No. 10,124,232, which is a continuation of U.S. application Ser. No. 15/722,700 filed on Oct. 2, 2017 now issued as U.S. Pat. No. 9,962,592, which is a continuation of U.S. application Ser. No. 15/442,693 filed on Feb. 26, 2017 now issued as U.S. Pat. No. 9,776,062, which is a continuation of U.S. application Ser. No. 14/742,031 filed on Jun. 17, 2015 which issued as U.S. Pat. No. 9,579,555, which claims priority to U.S. Provisional Application No. 62/013,036 filed Jun. 17, 2014. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND OF THE INVENTION

Field of the Invention

The present invention relates generally to an improved rail system for an exercise machine and more specifically it relates to an exercise machine rail system for improved exerciser mounting and dismounting, improved functional ergonomics, and reduced risk of exerciser injury when using an exercise machine.

Description of the Related Art

Any discussion of the related art throughout the specification should in no way be considered as an admission that such related art is widely known or forms part of common general knowledge in the field.

Contemporary exercise machines such as Pilates apparatuses are well known throughout the fitness industry. Those skilled in the art will immediately recognize a typical Pilates apparatus generally comprising a rectangular frame supporting a pair of parallel rails extending substantially the longitudinal dimension of the apparatus, a slidable exercise carriage slidable upon the rails, and one or more springs removably attached between one stationary end and the slidable carriage to create a resistance tension on the carriage against which an exerciser must overcome in order to move the slidable carriage in a direction opposite the stationary end.

In a traditional Pilates apparatus, a plurality of springs may be removably attached or detached between the structure and slidable carriage, thereby providing for increased or decreased resistance force as desired for each of the various exercises that may be performed upon a Pilates apparatus.

One major deficiency of contemporary Pilates apparatuses is a base structure of sufficient width and length to provide stability of the parallel rails and slidable carriage supported thereupon. The length and width dimensions of the support base typically define the overall perimeter length and width dimensions of the apparatus. However, the parallel rails, slidable carriage, and spring resistance means are typically installed within the perimeter dimensions of the support structure, and therefore require the exerciser to traverse the perimeter structure in order to mount or dismount the exercise surfaces of the apparatus.

Those skilled in the art will recognize that the slidable carriage is not stable, and slides along the rails as intended each time that an exerciser reaches over the support structure in order to mount or dismount the carriage. Therefore, there is an ever-present danger that the carriage will slide out from under exercisers any time they attempt to mount or dismount the apparatus, oftentimes resulting in exerciser injury and legal claims against the Pilates studio.

Another major deficiency of contemporary Pilates apparatuses is a rail configuration that creates additional points of apparatus contact by an exerciser that may result in injury. Traditional apparatuses comprise two parallel rails spaced substantially apart from each other, and supporting a slidable carriage thereupon, the distance between the parallel rails being sufficiently wide to accommodate the installation of a plurality of resistance springs therebetween.

At the foot end of the apparatus, the area defined as the lateral dimension between the parallel rails, and the longitudinal dimension between the slidable carriage and the stationary structure between which the springs are removably attached, create a "field of springs" that can routinely cause injury to exercisers who accidentally step or fall through the extended springs.

The opposite end of the apparatus, in an area defined as the lateral dimension between the rails, and the longitudinal dimension between the slidable carriage and the head end of stationary structure that contains no springs, define a second hazardous area of the apparatus. As one example, an exerciser performing a standing exercise upon the slidable carriage of the apparatus may momentarily lose their balance, and be forced to step off of a moving carriage toward the non-spring end. Already imbalanced, when stepping or falling off of the carriage, one foot may land upon one of the parallel rails, while the other foot falls between the rails, landing on the floor. As can readily be understood, the initial imbalance is exacerbated by a multi-rail structure that interferes with the exerciser's ability to regain balance by stepping unobstructed from the slidable carriage to the floor.

Yet another major deficiency of contemporary Pilates apparatuses is a long standardized configuration of a substantially open distance between parallel sliding rails that do not readily provide for support or enclosure of springs or alternative resistance means, for instance dashpots, eddy current brakes or friction blocks, nor do the open parallel rails provide for enclosing electrical or electronic circuits or wires, or hydraulic plumbing or associated mechanisms that may be used to control certain resistance means on an improved Pilates apparatus.

Those skilled in the art will immediately appreciate the need for an improved Pilates apparatus with smaller perimeter dimensions, and more specifically a smaller width dimension between the outside surfaces of the parallel sliding rails, the smaller dimensions thereby substantially reducing or eliminating certain hazard areas of a traditional apparatus, and correspondingly reducing the potential of injury to an exerciser.

It will also be appreciated that a new and novel exercise apparatus that eliminates or substantially reduces the need for exercisers to continually step over the perimeter structure while mounting and dismounting the apparatus will lead to fewer injuries, and correspondingly the studio's reduced exposure to legal liability and economic loss.

It will be further appreciated by those skilled in the art that new means of creating exercise resistance not currently provided for in traditional Pilates apparatuses, including for example, but not limited to dashpots, a plurality of vertically stacked resistance springs, or eddy current brakes, may best be structurally integrated and housed within centralized enclosed structure that supports a slidable exercise carriage.

Because of the inherent problems with the related art, there is a need for a new and improved exercise machine rail system for improved exerciser mounting and dismounting, improved functional ergonomics, and reduced risk of exerciser injury when using an exercise machine.

BRIEF SUMMARY OF THE INVENTION

The invention generally relates to an exercise machine which includes either two rails in close relationship which are linked together via connectors or a singular rail. Bias members are disclosed as either extending along either outer side of the rails, internally to the rail, or underneath the rail. Due to the narrow nature of the rails used by the present invention, an exerciser may mount and dismount the exercise machine easily.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
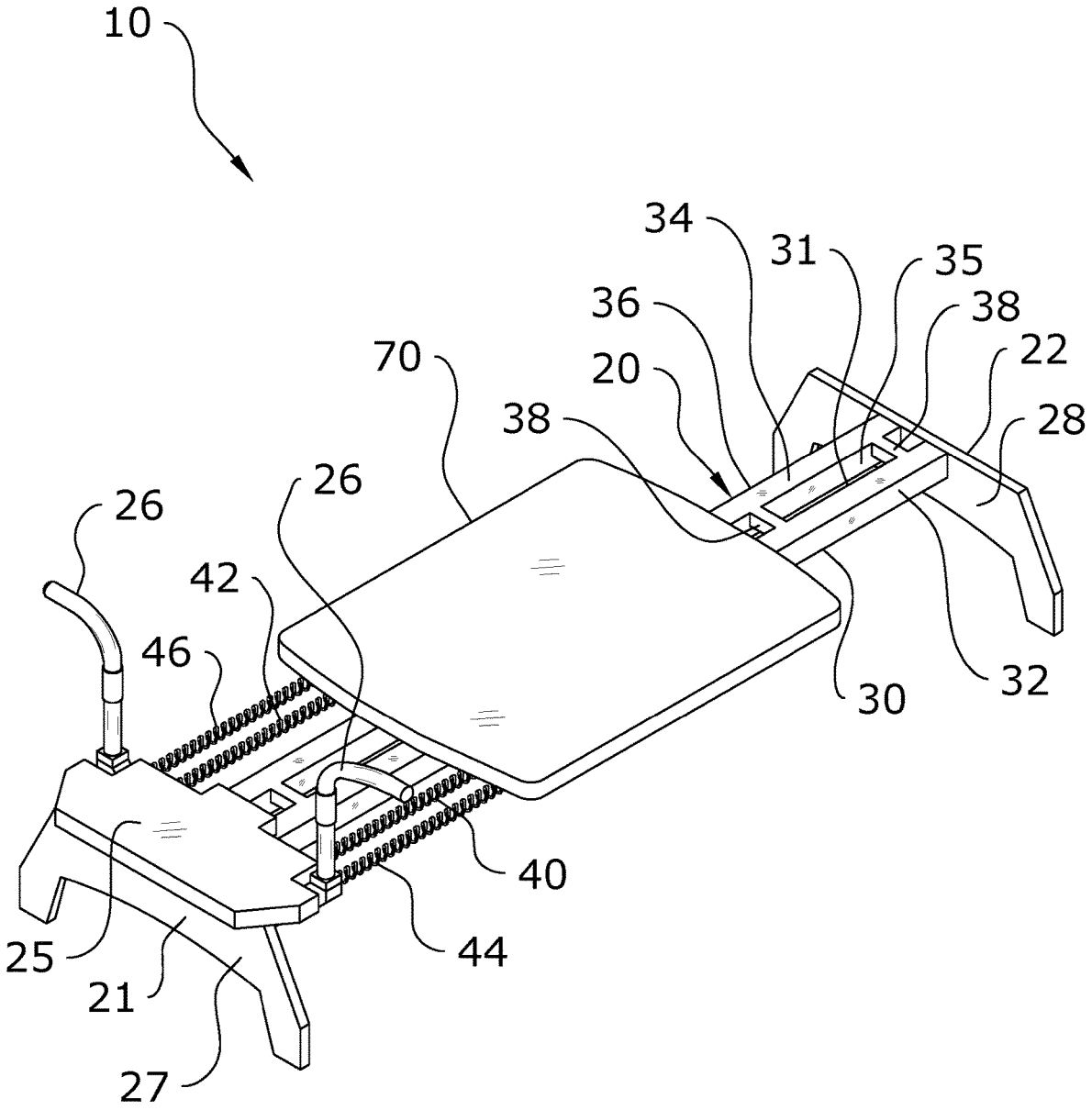
FIG. 1 is an upper perspective view of a first embodiment of the present invention.
Figure 2:
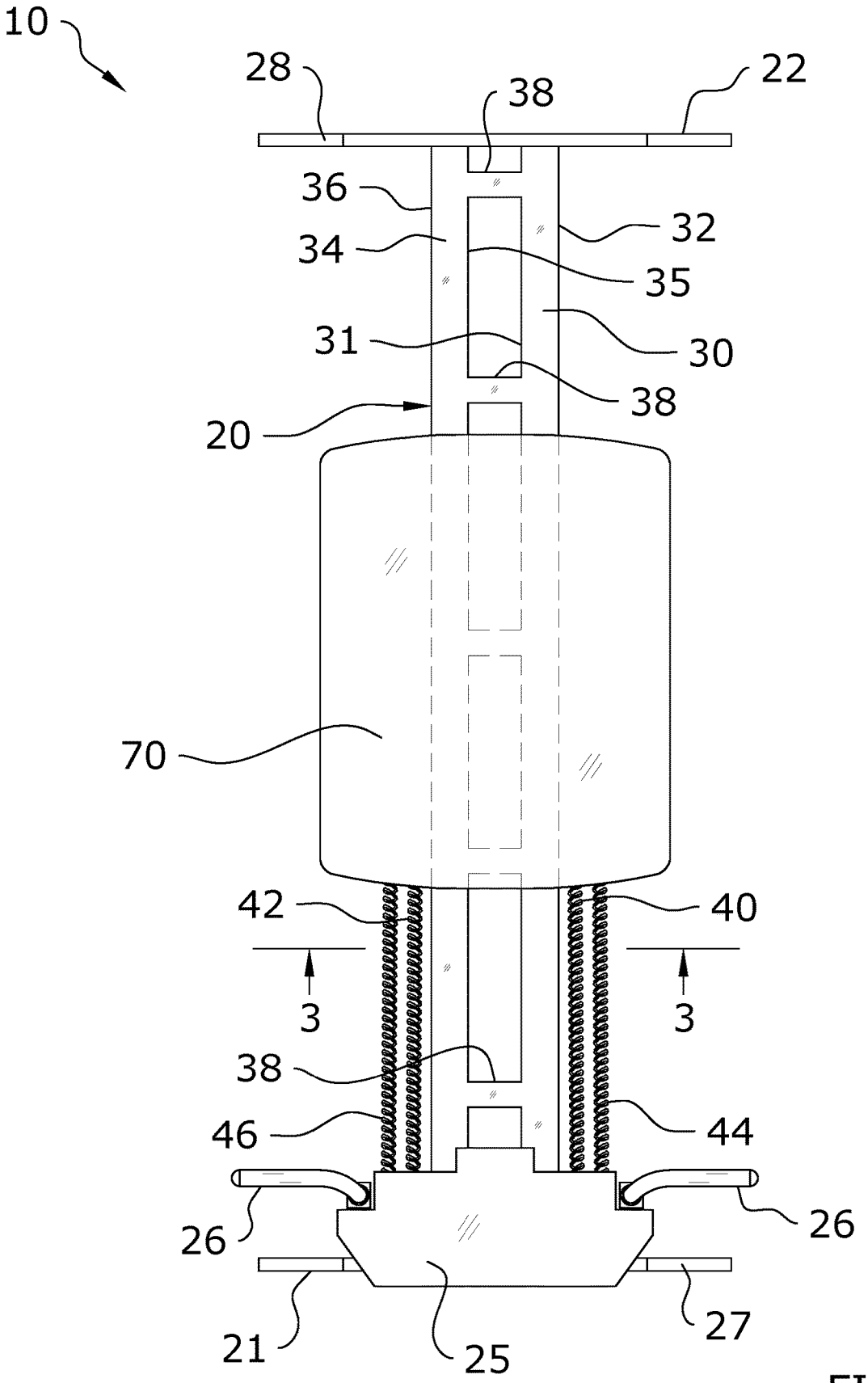
FIG. 2 is a top view of a first embodiment of the present invention.

A. Overview.

Turning now descriptively to the drawings, in which similar reference characters denote similar elements throughout the several views, FIGS. 1 through 16 illustrate an exercise machine rail system 10, which comprises either two rails 30, 34 in close relationship which may be linked together via connectors 38 or a singular rail 50. The pair of rails 30, 40 do not require connectors 38 between them, but it is preferred to have connectors 38 between the rails 30, 40 to ensure stability of the respective rails 30, 40 during usage by an exerciser. Bias members 40, 42, 44, 46 are disclosed as either extending along either outer side of the rails 30, 34, 50, internally to the rail 50, or underneath the rail 50. Due to the narrow nature of the rails 30, 34, 50 used by the present invention, an exerciser may mount and dismount the exercise machine 20 easily.

Figure 3:
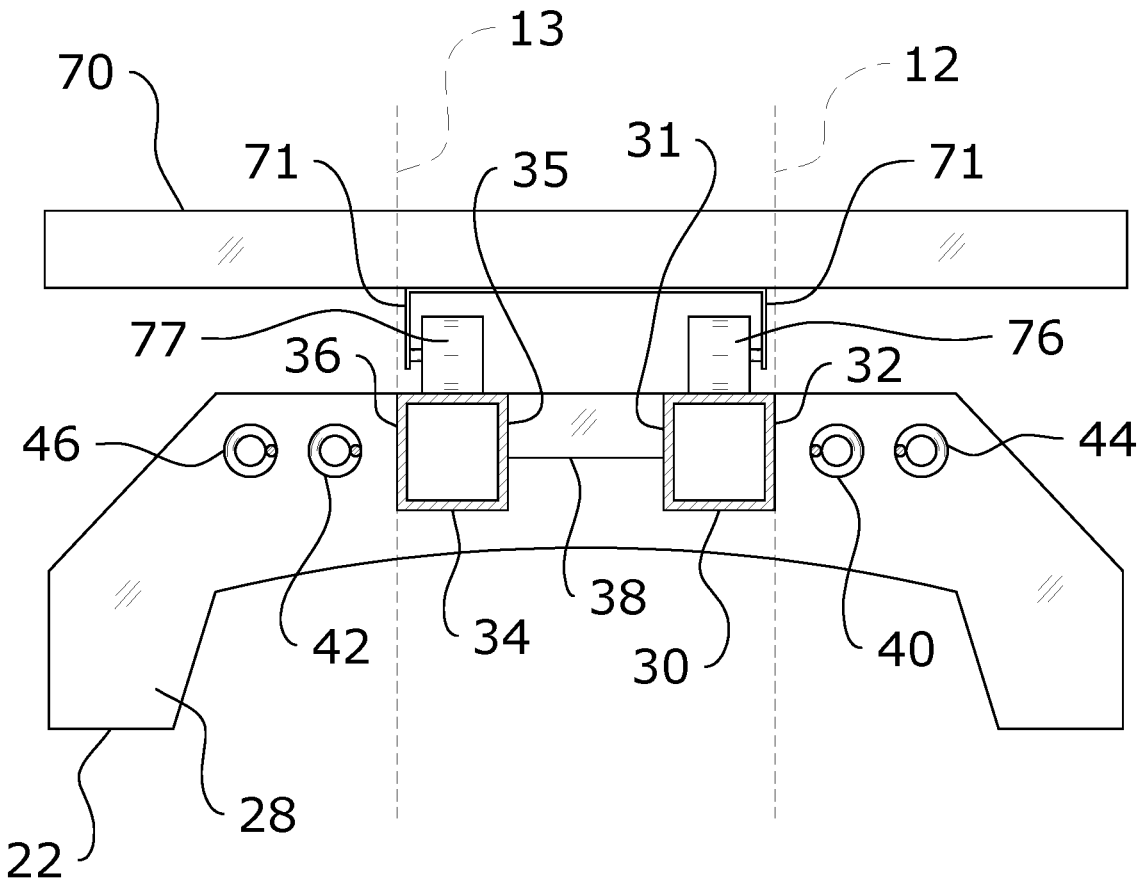
FIG. 3 is a sectional view taken along line 3-3 of FIG. 2.
Figure 8:
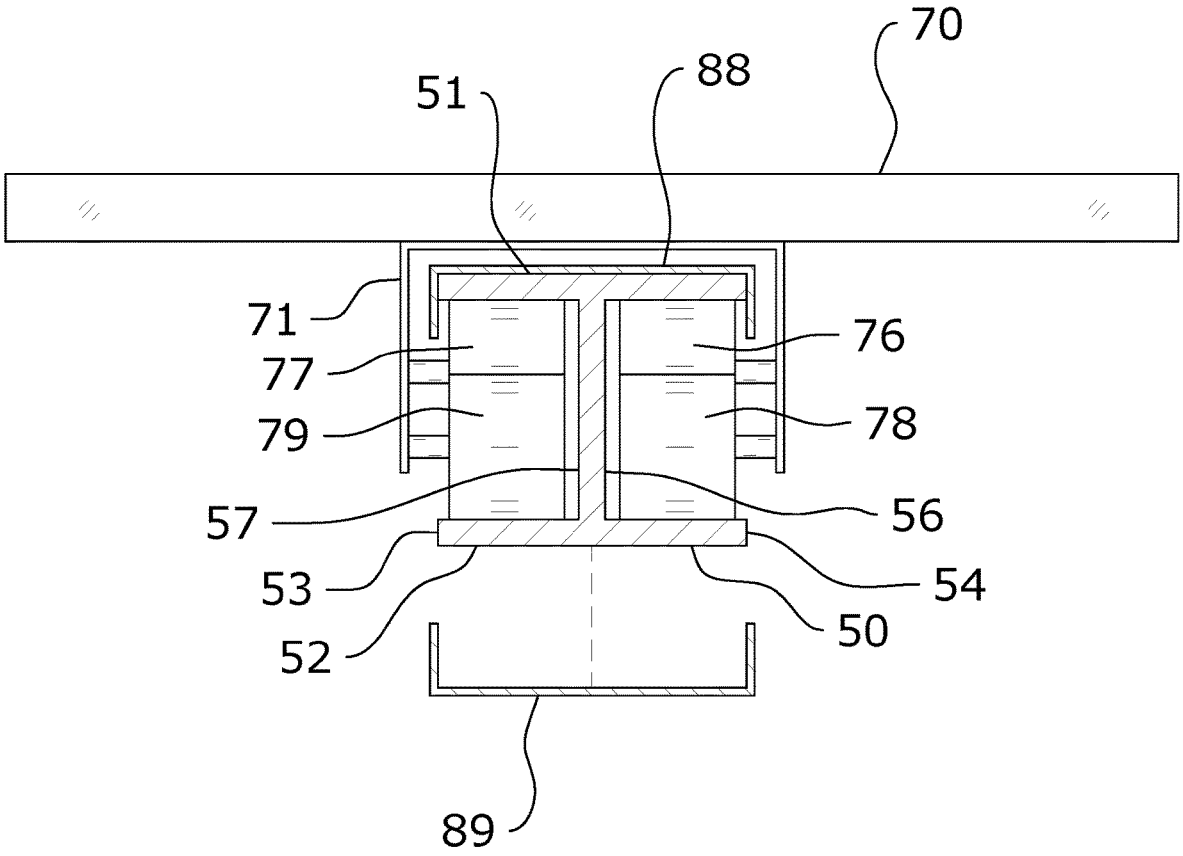
FIG. 8 is a sectional view of the second embodiment of the present invention.

It is important that the width of the rail support structure (e.g. a single rail 50 or a pair of rails 30, 34) be significantly less than the overall width of the exercise machine. FIGS. 2, 3, 7, 12 provide exemplary views of the significantly narrower rail support structure compared to the overall width of the exercise machine. It is preferable that the rail support structure is significantly narrower than the first support 27 and the second support 28. It is preferable that the rail support structure is significantly narrower than the portions of the first support 27 and the second support 28 that physically contact the ground surface. As illustrated in FIGS. 2, 3, 7, 12, the rail support structure preferably has a width of less than 50% of the width of the overall width of the exercise machine. As further illustrated in FIGS. 2, 3, 7, 12, the rail support structure preferably has a width of less than 50% of the width of the overall width of the portions of the first support 27 and the second support 28 that physically contact the ground surface. While the rail support structure is narrow in width, the frame of the exercise machine is significantly wider than the rail support structure to provide stability to the exercise machine and the carriage 70 moving along the rail support structure during usage by an exerciser. The bias members 40, 42, 44, 46 are positioned on opposite sides of the narrow rail support structure that supports the carriage 70. The bias members 40, 42, 44, 46 may also be positioned directly below the narrow rail support structure that supports the carriage 70. The width of the rail support structure is further preferably equal to or greater than the height of the rail support structure as shown in FIGS. 3 and 8.

More specifically, the present invention teaches an improvement over the separated wide parallel sliding rails of the prior art as a narrow rail support structure, comprising either a pair of narrowly spaced-apart but close-together rails 30, 34 or a singular rail 50 (e.g. a monorail), extending substantially the longitudinal dimension of an exercise machine 20 and positioned along the longitudinal centerline of the exercise machine 20, the monorail structure supporting a plurality of wheels 76, 77, 78, 79 affixed to a carriage 70 to engage and slide upon the supporting surfaces of the rails 30, 34, 50.

The monorail structure of the present invention eliminates the need for a perimeter structure to support two individually affixed parallel sliding rails, thereby substantially reducing the overall width dimension of the exercise machine 20 between the first end 21 and the second end 22. The single, centrally positioned monorail structure therefore solves the deficiency of traditional apparatuses that require exercisers 11 to traverse a perimeter support structure before mounting or dismounting the carriage 70.

Those skilled in the art will immediately appreciate the significant commercial advantages of the present invention, including the comfort and ease with which exercisers 11 can mount and dismount the exercise machine 20, the reduction in injury potential, and the ability to incorporate a variety of resistance-inducing mechanisms, including bias members 40, 42, 44, 46 and alternative mechanisms, within a centralized support housing and monorail sliding structure.

One exemplary embodiment of the present invention is an exercise machine 20 providing for the reduction in the lateral dimension of a contemporary Pilates apparatus by eliminating the traditional parallel rails separately affixed to a perimeter support structure, and replacing the parallel rails with a medially positioned monorail structure.

Another exemplary embodiment of the present invention is an exercise machine 20 comprising a carriage 70 supported by the monorail structure, the monorail structure thereby substantially enclosing a plurality of possible bias members 40, 42, 44, 46 attached between a carriage 70 and substantially stationary structure of the exercise machine 20.

Yet another exemplary embodiment of the present invention is a monorail structure extending substantially the length of an improved exercise machine 20 comprising bilateral channels 56, 57 within which wheels 76, 77, 78, 79 affixed to a carriage 70 may slide.

Yet another exemplary embodiment of the present invention is a monorail structure assembly extending substantially the length of an improved exercise machine 20, the assembly comprising a left and right trolley wheel rails 30, 34, the rails 30, 34 being parallel and in close proximity to each other, and affixed to each other via connectors 38 to form a single structural monorail.

Another exemplary embodiment of the present invention is a monorail structure assembly extending substantially the length of an improved exercise machine 20, the opposed ends of the monorail being affixed to supports 27, 28.

Still another exemplary embodiment of the present invention is a monorail structure assembly extending substantially the length of an improved exercise machine 20, with a first end of the monorail being affixed to a first end 21 of the exercise machine 20, and the second end of the monorail being cantilevered from the second end 22 of the exercise machine 20, thereby eliminating the requirement to affix the second end 22 to a vertical support 28.

Another exemplary embodiment of the present invention is an exercise machine 20 comprising a monorail structure supporting a carriage 70, the monorail structure providing for a single, hollow rail 50 that substantially encloses the bias members 40, 42, 44, 46, thereby reducing potential for injury by preventing an exerciser 11 from contacting the bias members 40, 42, 44, 46.

These and other embodiments will become known to one skilled in the art, especially after recognizing the commercial value and safety advantages of an exercise machine 20 of reduced dimensions by use of a novel monorail structure supporting a carriage 70, a monorail structure providing for the enclosure of bias members 40, 42, 44, 46 to reduce the potential for exerciser injury, and a monorail structure accommodating bias members 40, 42, 44, 46. The present invention is not intended to be limited to the disclosed embodiments.

B. Exercise Machine.

The present invention may be used to form various types of exercise machines 20 such as, but not limited to, a Pilates machine and various other types of fitness equipment. The exercise machine 20 may be comprised of the exercise machine described and shown in U.S. Pat. No. 8,641,585, issued on Feb. 4, 2014 and U.S. Pat. No. 7,803,095, which are hereby fully incorporated by reference.

As shown throughout the figures, the exercise machine 20 generally includes a first end 21 and a second end 22 opposite of the first end 21. One or more rails 30, 34, 50 extend between the first end 21 and the second end 22 of the exercise machine 20. A carriage 70 is generally movably secured along the one or more rails 30, 34, 50 so as to slide between the first and second ends 21, 22 of the exercise machine 20.

One or more bias members 40, 42, 44, 46 are connected between the carriage 70 and either end 21, 22 of the exercise machine 20 such that the bias members 40, 42, 44, 46 exert resistance on the carriage 70 as it is moved away from the end 21, 22 of the exercise machine 20 to which the bias members 40, 42, 44, 46 are secured. The bias members 40, 42, 44, 46 may comprise various structures, devices, or the like which provide resistance in one direction of movement, such as resistance springs.

The positioning of the bias members 40, 42, 44, 46 will vary depending on the embodiment of the present invention. For the embodiments shown in FIGS. 1-7, the bias members 40, 42, 44, 46 are positioned on the outer sides of the rails 30, 34, 50. For the embodiment shown in FIGS. 9-10, the bias members 40, 42, 44, 46 extend underneath the rail 50. For the embodiments shown in FIGS. 11-14, the bias members 40, 42, 44, 46 extend within the rail 50 itself.

In some embodiments, the exercise machine 20 may include one or more platforms 25 at either end 21, 22 of the exercise machine 20. For example, FIG. 1 of the drawings shows a platform 25 positioned at the first end 21 of the exercise machine 20. While the figures do not illustrate a platform 25 on the second end 22 of the exercise machine 20, it should be appreciated that a platform 25 may be positioned at the second end 22 in addition to or in alternative to a platform 25 being positioned at the first end 21. One or more handles 26 may also extend from the first end 21, the second end 22, or both ends 21, 22 of the exercise machine 20 in some embodiments.

The exercise machine 20 may be supported by a number of methods known in the art for supporting an exercise machine 20. In one embodiment shown in FIG. 1, the exercise machine 20 includes a first support 27 at its first end 21 and a second support 28 at its second end 22. A representative exerciser 11 is shown mounting the exercise machine 20 using three points of simultaneous contact with the exercise machine 20, namely one knee and one hand on the carriage 70, and one hand grasping one exercise handle 26. The rail 50 is sufficiently narrow so as to allow an exerciser 11 to approach the carriage 70 from the second end 22 by straddling the rail 50 with one foot on either side, and simply walking toward the carriage 70 unimpeded by perimeter support structures or a plurality of rails.

As will be immediately appreciated by those skilled in the art, the mounting technique on an improved exercise machine 20 with integrated rail 50 as just described, substantially improves the safety of the exerciser 11 mounting and dismounting, and reduces the risk of injury when compared to conventional apparatuses with parallel rails and perimeter support structure.

Figure 16:
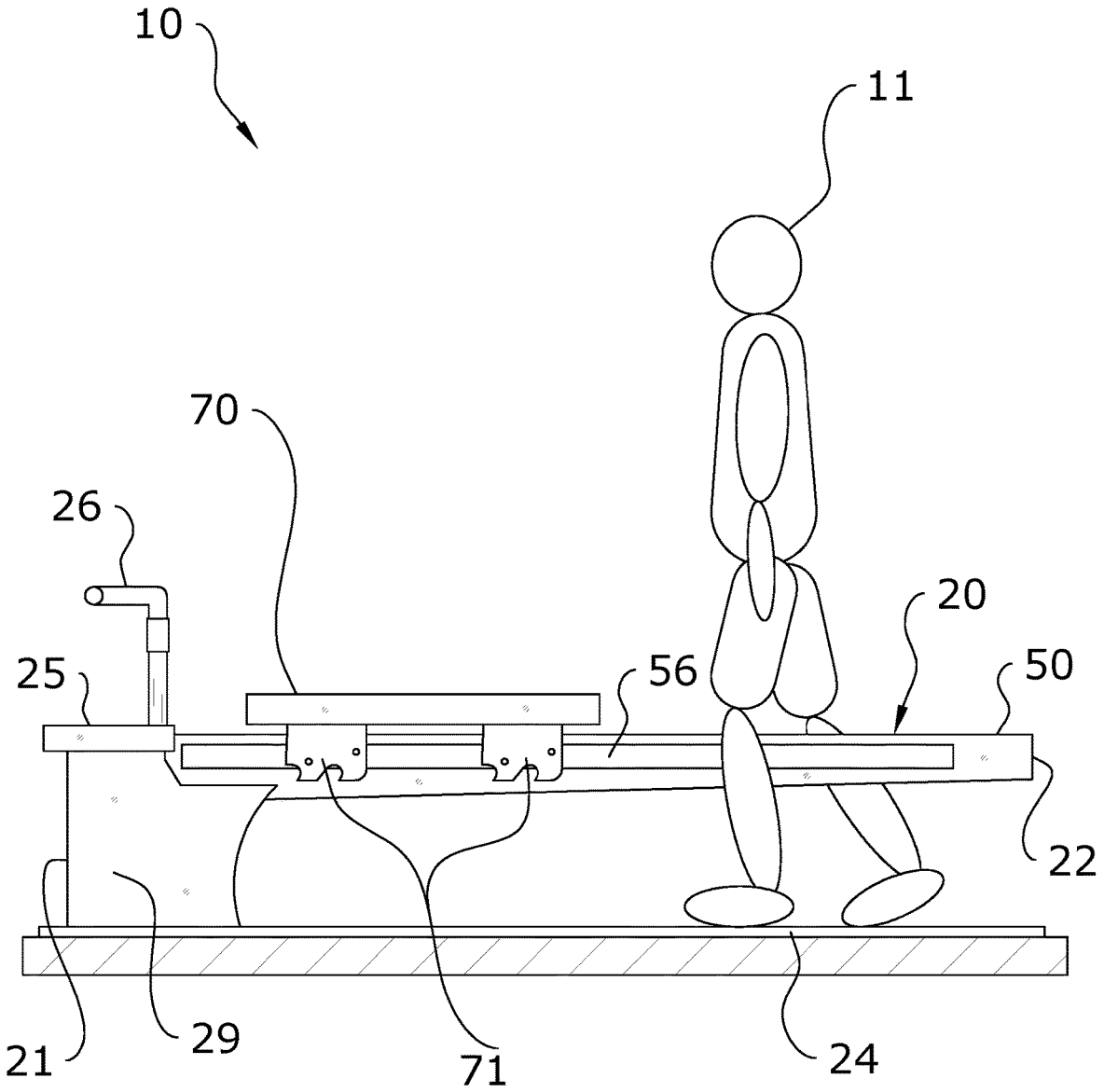
FIG. 16 is a side view of a cantilevered embodiment of the present invention.

In another embodiment shown in FIG. 16, the exercise machine 20 utilizes a support tower 29 at its first end 21, thereby cantilevering the second end 22 of the exercise machine 20 above a floor surface without any direct support. The support tower 29 may be affixed to a support base 24 that is of such length and width, and in such a manner, so as to counterbalance the downward-loading forces that may be reasonably applied to the second end 22 of the cantilevered exercise machine 20, thereby preventing the second end 22 of the exercise machine 20 from tipping towards the floor.

As can readily be seen in FIG. 16, the cantilevered embodiment of the present invention further increases the ease with which a representative exerciser 11 may approach the carriage 70 merely by walking toward it from the second end 22 of the exercise machine 20 by straddling the rail 50. In the embodiment as illustrated, an exerciser 11 would never be concerned about encountering a second support structure at the second end 22 of the exercise machine 20.

When compared to an attempt to cantilever two parallel rails of a traditional exercise machine 20, it would be immediately apparent to those skilled in the art that a substantial structure between the independent parallel rails would be required in order to counteract the torsional forces that would be created by an exerciser 11 sitting upon one edge of the carriage 70. Such a structure would be cumbersome, expensive, commercially non-competitive, and would nevertheless remain sufficiently wide so as to prevent an exerciser 11 from straddling the entirety of the structure while attempting to walk upon the floor to approach the carriage 70.

On the other hand, the narrower rail 50 structure of the present invention, being of a formed beam structure, readily provides for torsional force resistance using well-known properties of the materials used, and engineered to easily counteract the anticipated torsional forces expected to be encountered, all the while, maintaining a dimensionally compact and efficient rail 50 structure.

It should be appreciated that exercise machines 20 are often installed in commercial gym facilities that have structurally sound and robust floors. As an alternative to, or used in conjunction with the supports 27, 28 or support tower 29 described herein, smaller support bases (not shown) may be affixed to the floor by many well-known methods, such as concrete anchor bolts, thereby transmitting loads at the second end 22 of the cantilevered exercise machine 20 to the floor structure.

C. First Rail Embodiment and Operation Thereo.

FIGS. 1-4 illustrate a first embodiment of the present invention in which a pair of rails 30, 34 extend in close spaced-apart relationship with each other between the first end 21 and the second end 22 of the exercise machine 20. It is preferable that the rails 30, 34 be minimally spaced from each other so that, taken together, the pair of rails 30, 34 comprise a narrow structure which is easy to straddle or walk around for an exerciser 11. The carriage 70 is adapted to move, such as by sliding, along the pair of rails 30, 34 through various methods known in the art for moving a carriage 70 along rails 30, 34.

In the first embodiment of the present invention, the first rail 30 and second rail 34 extend parallel with respect to each other. The first rail 30 includes a first interior side 31 which faces toward the second rail 34 and a first exterior side 32 which faces away from the second rail 34. Similarly, the second rail 34 includes a second interior side 35 which faces toward the first rail 30 and a second exterior side 36 which faces away from the first rail 30.

For reference, FIG. 3 shows a first longitudinal axis 12 which extends perpendicularly with respect to the first exterior side 32 and a second longitudinal axis 13 which extends perpendicularly with respect to the second exterior side 36. An inner side of the first longitudinal axis 12 faces toward the second longitudinal axis 13 and an outer side of the first longitudinal axis 12 faces away from the second longitudinal axis 13. Similarly, an inner side of the second longitudinal axis 13 faces toward the first longitudinal axis 12 and an outer side of the second longitudinal axis 13 faces away from the first longitudinal axis 12.

The two rails 30, 34 are assembled together to form a unitized monorail structure as shown in the figures. More specifically, the two rails 30, 34, which extend substantially the length of the exercise machine 20, are permanently connected to each other using one or more connectors 38 to create a structurally robust monorail structure upon which the carriage 70 may slide.

It should be noted that the connectors 38 may be spacers allowing minimal spacing between the rails 30, 34, connected through the rails 30, 34 using traditional mechanical fasteners such as rivets or bolts and nuts. Alternately, a pair of metal rails 30, 34 may be permanently welded to form a unitized monorail structure, with the connectors 38 being comprised of the welds. Further, extruded or formed synthetic rails 30, 34, for instance, rails 30, 34 fabricated by extruding or forming polymers or fiberglass-reinforced plastic, may be permanently joined using connectors 38 such as known polymer adhesives or mechanical fasteners, thereby creating the unitized monorail structure.

In FIG. 1, it can be readily seen that the narrowness of the monorail structure of the connectors rails 30, 34 provides for the relocation of bias members 40, 42, 44, 46 from between the parallel rails 30, 34, more beneficially to the lateral outside of the rails 30, 34. More specifically, a first bias member 40 may be near or distally spaced with respect to the first exterior side 32 and a second bias member 42 may be near or distally spaced with respect to the second exterior side 36. With reference to the longitudinal axes 12, 13 defined above, the first bias member 40 will be positioned on an outer side of the first longitudinal axis 12 and the second bias member 42 will be positioned on an outer side of the second longitudinal axis 13. In some embodiments, the first bias member 40 may run alongside the first exterior side 32 and the second bias member 42 may run alongside the second exterior side 36. The bias members 40, 42, 44, 46 are not positioned between the two rails 30, 34.

When the carriage 70 is in its resting position against a stop (for example, a platform 25), having been pulled toward the first end 21 by the bias members 40, 42, 44, 46, no bias members 40, 42, 44, 46 are exposed to the exerciser 11 attempting to mount or dismount the exercise machine 20. Therefore, the replacement of traditional, widely separated parallel sliding rails by the monorail structure of the present invention provides for an exerciser 11 to more closely position themselves to the exercise surfaces of the exercise machine 20, thereby substantially increasing the ease and safety of mounting and dismounting the exercise machine 20.

Figure 4:
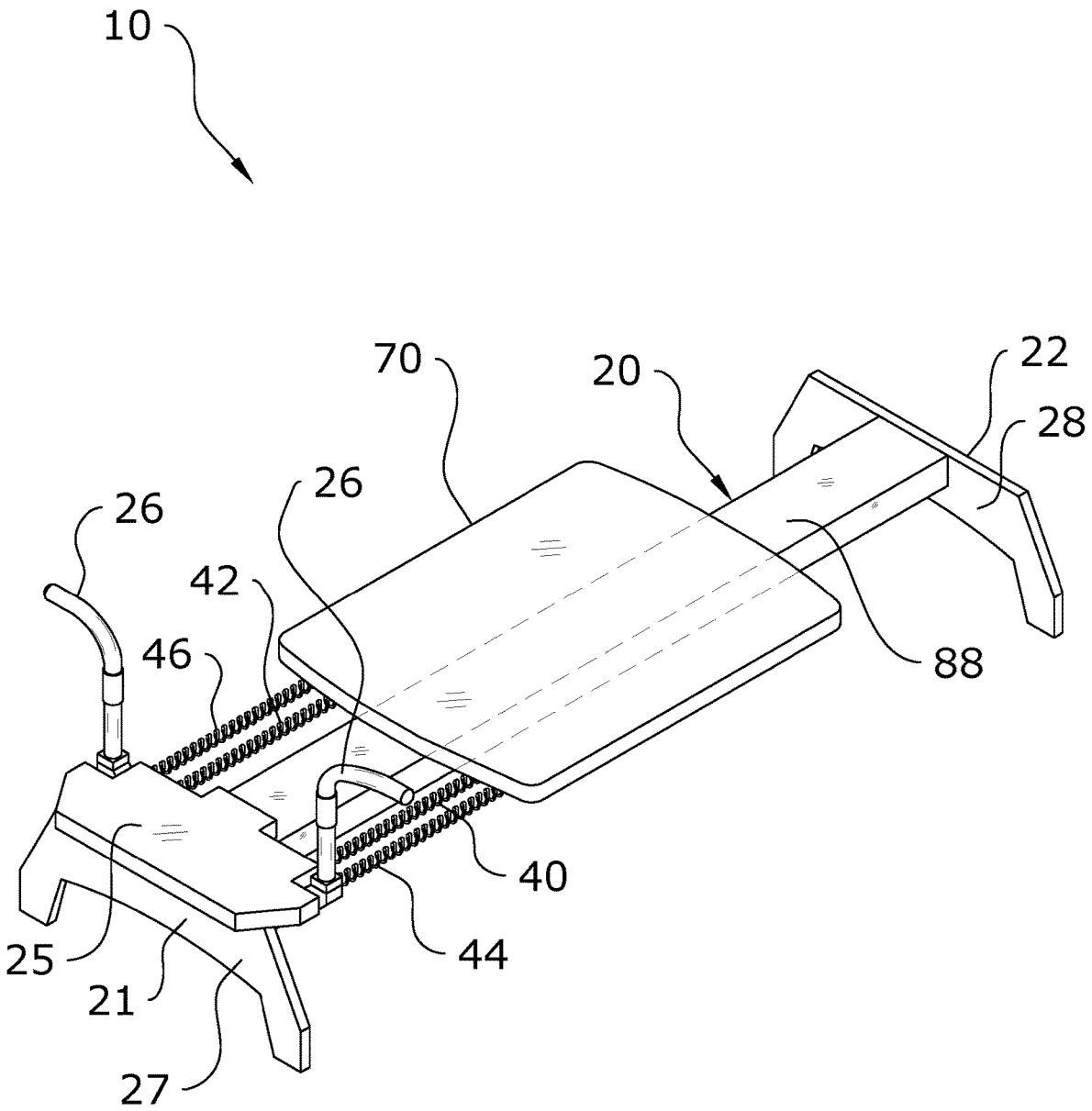
FIG. 4 is an upper perspective view of a first embodiment of the present invention with the protective cover installed.

As shown in FIG. 4, a first protective cover 88 may be installed over the first and second rails 30, 34. Such a first protective cover 88 will preferably run the length of the rails 30, 34 and close any openings that may exist between the rails 30, 34 of the present invention, such as gaps between connectors 28.

In use, an exerciser 11 may easily straddle the rails 30, 34 to position herself on the carriage 70. The carriage 70 may then be moved by the exerciser 11 away from the first end 21 of the exercise machine 20, with the bias members 40, 42, 44, 46 providing resistance which will provide a workout for the exerciser 11. The positioning of the bias members 40, 42, 44, 46 on the outer sides of the rails 30, 34 aids in preventing injury to the exerciser 11 when the present invention is in use.

D. Second Rail Embodiment and Operation Thereo.

FIGS. 5-10 illustrate a second embodiment of the present invention which utilizes a single rail 50 which is centrally positioned along the longitudinal axis of the exercise machine 20 and bias members 40, 42, 44, 46 positioned laterally to the singular rail 50. The rail 50 extends between the first end 21 and the second end 22 of the exercise machine 20. The rail 50 includes an upper end 51, a lower end 52, a first side 53, and a second side 54.

The rail 50 may comprise various configurations, but will preferably comprise an I-shaped cross-section as shown in the figures, with the rail 50 comprising an I-beam. With such a configuration, the rail 50 includes a first channel 56 extending along its first side 53 and a second channel 57 extending along its second side 54.

The interconnection between the carriage 70 and the rail 50 is best shown in FIG. 8. Generally, one or more wheels 76, 77, 78, 79 will extend down from the carriage 70, such as by usage of a lower bracket 71, to engage with the channels 56, 57 in the rail 50. In the figures, the wheels 76, 77, 78, 79 engage with the exterior surfaces of the rail 50. It should be appreciated, however, that various other configurations may be utilized for movably connecting the carriage 70 to the rail 50.

In the preferred embodiment shown in FIG. 8, a lower bracket 71 extends downwardly from the bottom of the carriage 70. One or more wheel assemblies, each comprising a plurality of wheels 76, 77, 78, 79, extend inwardly from the lower bracket 71 to engage within the respective channels 56, 57. In the embodiment shown in the figures, a first wheel assembly comprised of a first upper wheel 76 and a first lower wheel 78 engage within the first channel 56. A second wheel assembly comprised of a second upper wheel 77 and a second lower wheel 79 engage within the second channel 57.

The lower wheels 78, 79 engage with the lower surface of the channels 56, 57 while the upper wheels 76, 77 engage with the upper surface of the channels 56, 57, thereby providing resistance to uplift forces that may be exerted on the carriage 70. For example, when an exerciser 11 puts weight on a second side of the carriage 70, the first upper wheel 76 will press against the upper surface of the first channel 56 while the second lower wheel 79 is pressed against the lower surface of the second channel 57. Thus, the use of both upper and lower wheels 76, 77, 78, 79 will prevent any wobbling or other undesired movement of the carriage 70 which may be caused by rotational torque applied to the carriage 70 as a result of use of the narrow rail 50 in combination with the wider carriage 70.

It should be appreciated that, to increase stability even further, additional wheel assemblies may be utilized. While the figures only illustrate two wheel assemblies being utilized, with one being positioned on each side 53, 54 of the rail 50, some embodiments may utilize two additional wheel assemblies. This configuration would result in two wheel assemblies on the first side 53 of the rail 50 and two wheel assemblies on the second side 54 of the rail 50.

Figure 5:
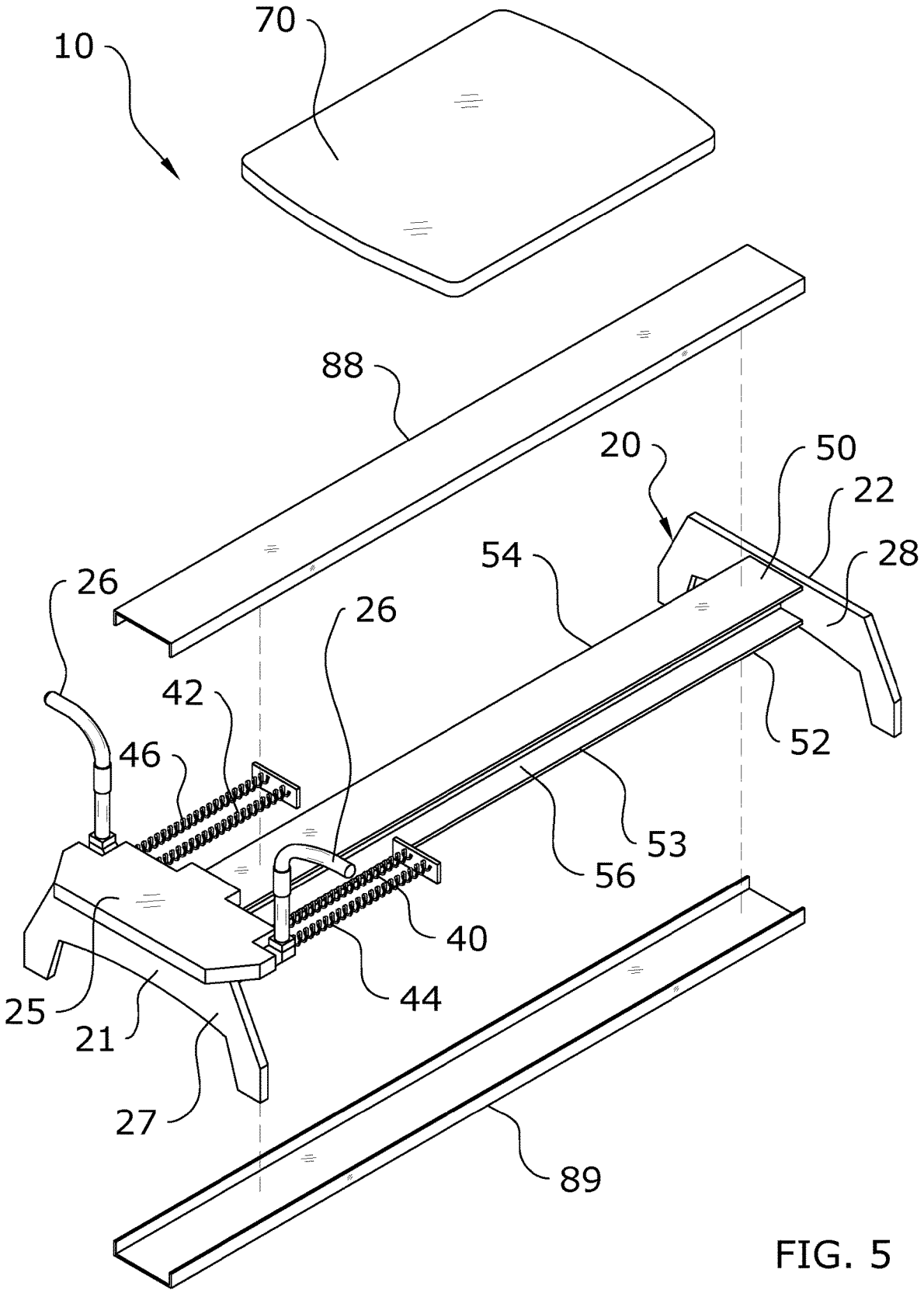
FIG. 5 is an upper perspective view of a second embodiment of the present invention illustrating alignment of the protective covers.
Figure 6:
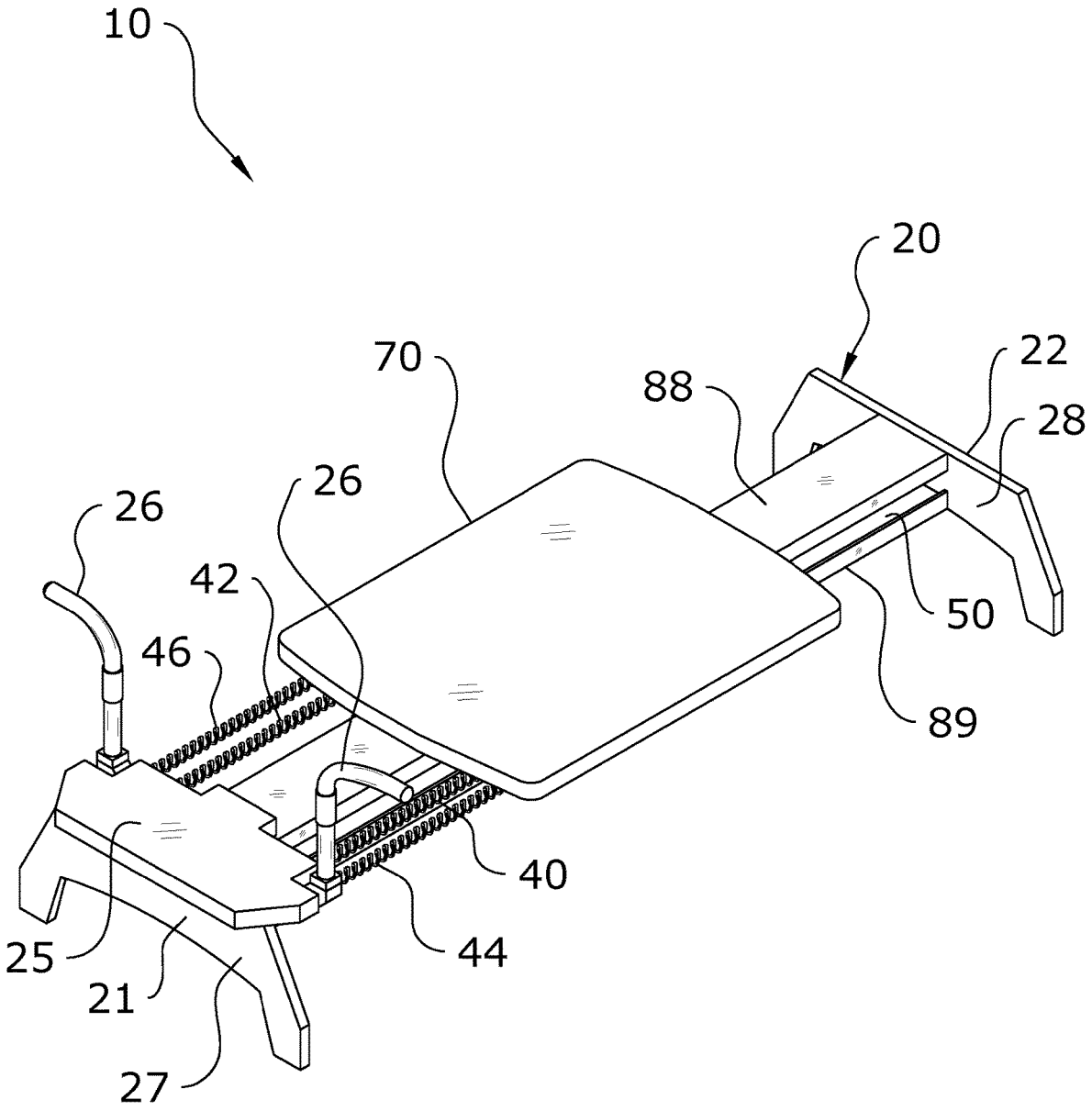
FIG. 6 is an upper perspective view of a second embodiment of the present invention with the protective covers installed on the rail.
Figure 7:
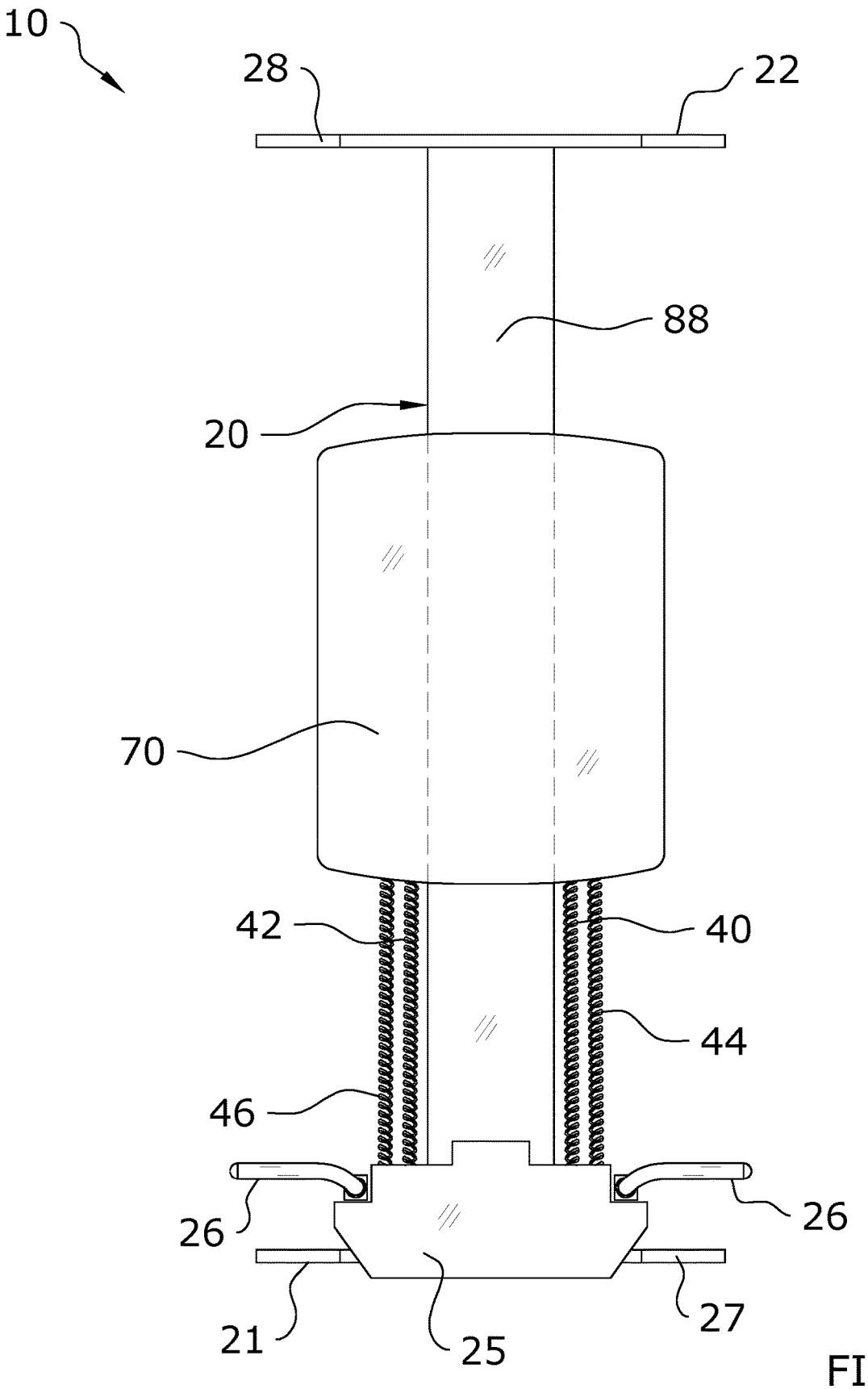
FIG. 7 is a top view of a second embodiment of the present invention with the protective covers installed on the rail.

Optionally, protective covers 88, 89 may be provided to substantially cover the rail 50. As shown in FIGS. 5-6, a first protective cover 88 may be positioned over the upper end 51 of the rail 50 and a second protective cover 89 may be positioned under the lower end 52 of the rail 50. When installed together, the protective covers 88, 89 substantially enclose channels 56, 57 except for a slight gap to allow for the axles of the wheels 76, 77, 78, 79 to extend out of the channels 56, 57 and connect to the lower bracket 71.

As best shown in FIG. 6, this embodiment may use bias members 40, 42, 44, 46 which are positioned on the exterior lateral sides of the rail 50. Thus, at least a first bias member 40 will be positioned near or distally spaced with respect to the first side 53 of the rail 50 and a second bias member 42 will be positioned near or distally spaced with respect to the second side 54 of the rail 50. Thus, the first bias member 40 will generally extend alongside the first side 53 while the second bias member 42 will generally extend alongside the second side 54. Additional bias members 44, 46 may also be utilized. For example, as shown in the figures, a third bias member 44 extends outside and alongside the first bias member 40 and a fourth bias member 46 extends outside and alongside the second bias member 42.

Figure 9:
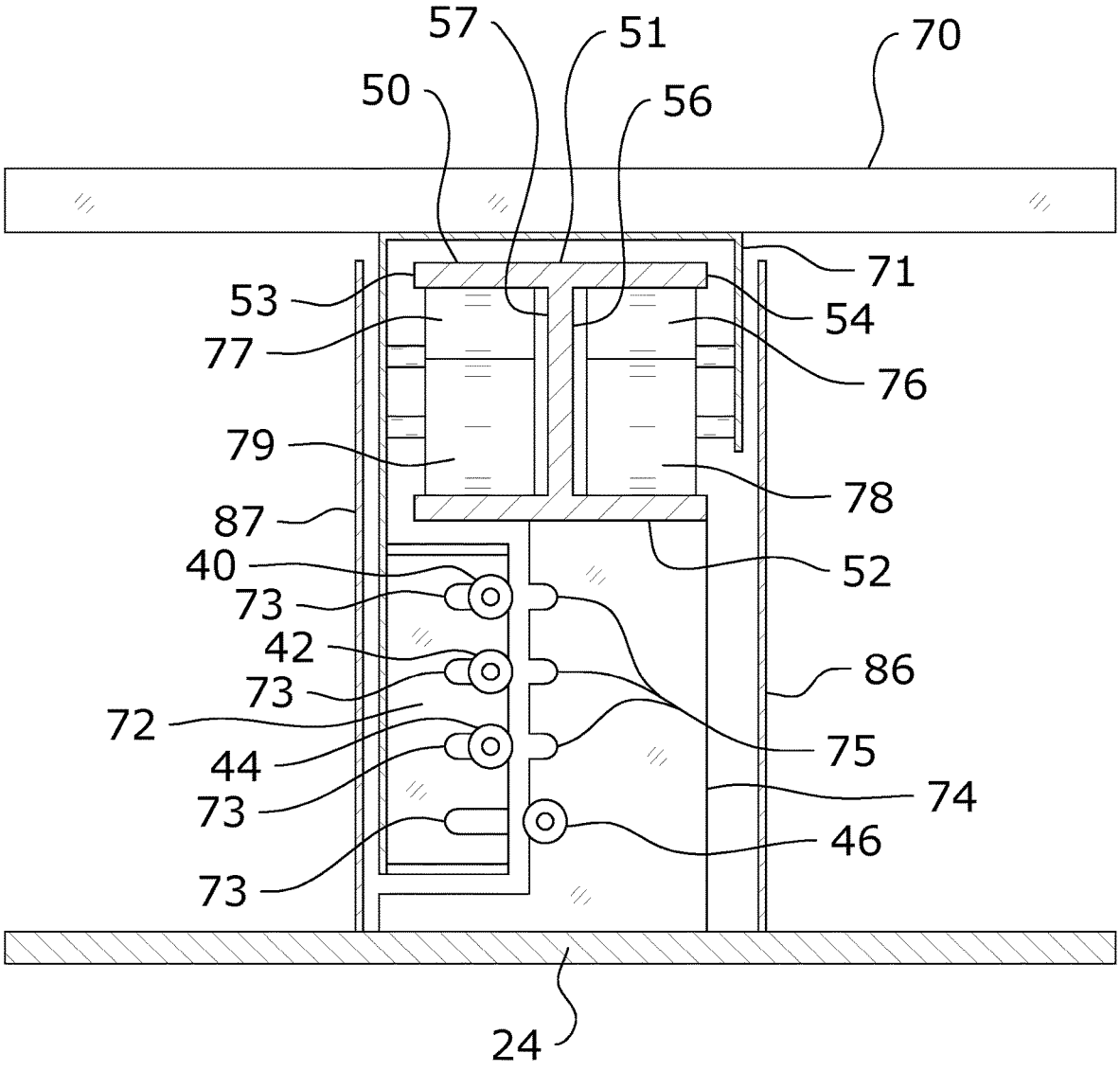
FIG. 9 is a sectional view of the second embodiment of the present invention which includes a system for varying resistance.
Figure 10:
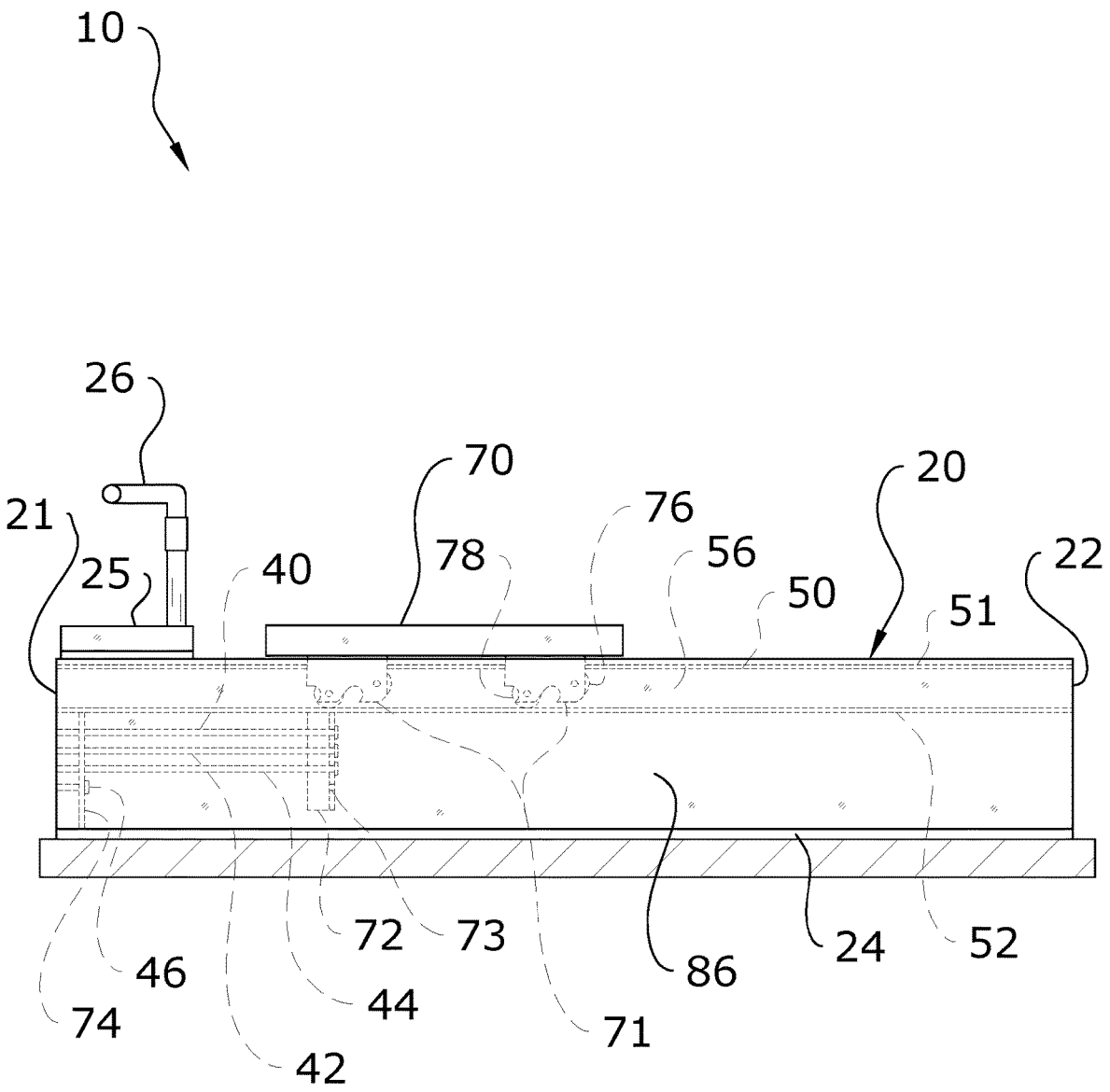
FIG. 10 is a side internal view of the second embodiment of the present invention which includes a system for varying resistance.
Figure 11:
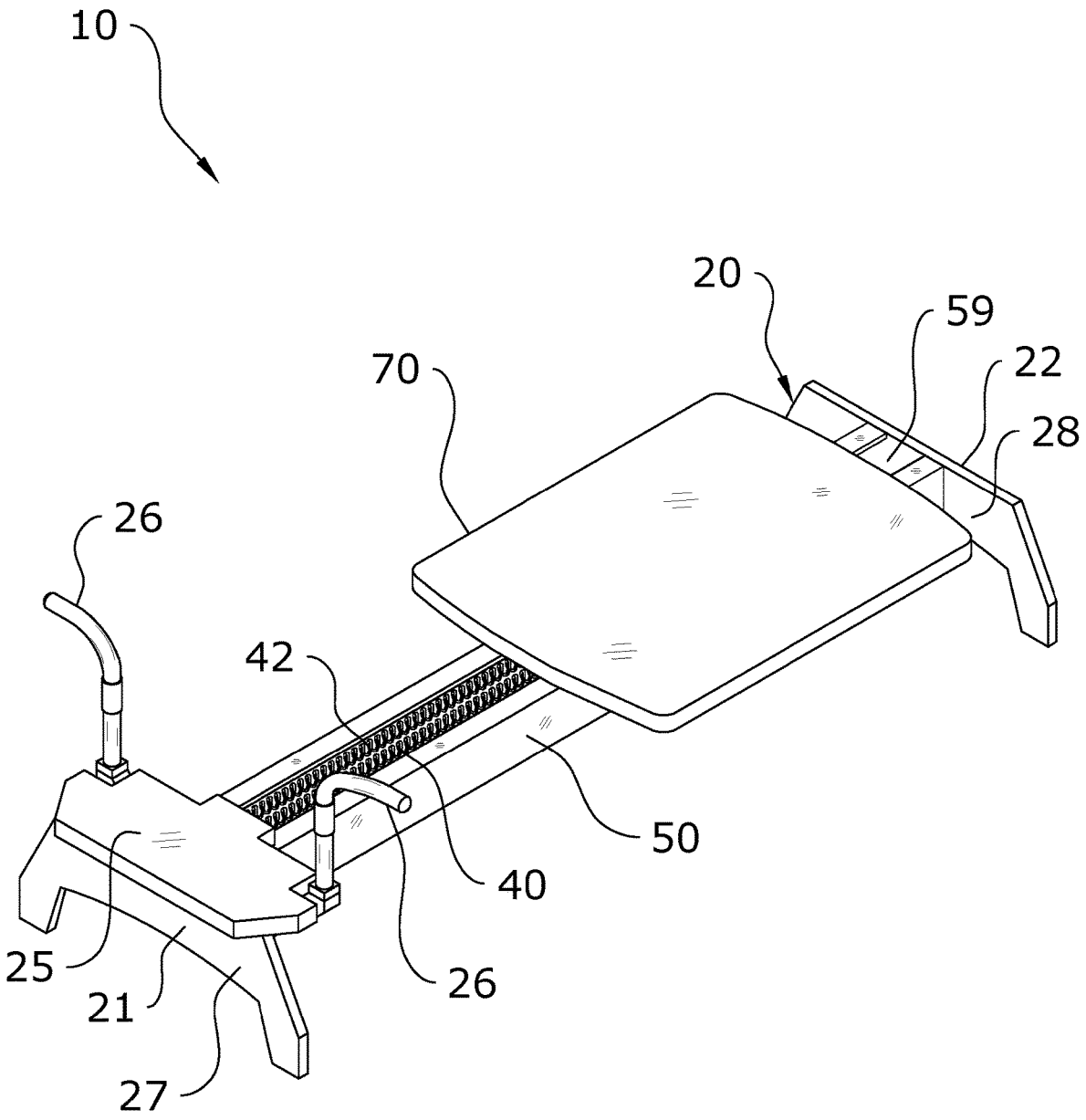
FIG. 11 is an upper perspective view of a third embodiment of the present invention.

FIGS. 9-10 illustrate an embodiment in which the I-shaped rail 50 is utilized in combination with bias members 40, 42, 44, 46 which are positioned underneath the rail 50 and enclosed by a pair of outer panels 86, 87. In such an embodiment, variable resistance may be provided for. A lower bracket 71 extends downwardly from the carriage 70, with a bias mount 72 extending from the lower bracket 71.

The bias mount 72 includes a plurality of receiver slots 73 adapted to receive one or more of the bias members 40, 42, 44 which are intended to provide resistance force on the carriage 70. A separate support member 74 is provided adjacent to the bias mount 72 which includes a plurality of support slots 75 adapted to receive one or more of the bias members 46 which are not intended to provide resistance force on the carriage 70. By selectively connecting the bias members 40, 42, 44, 46 in either the receiver slots 73 of the bias mount 72 or the support slots 75 of the support member 74, one may adjust the resistance being applied to the carriage 70.

As shown in FIG. 9, outer panels 86, 87 may be provided to enclose the bias members 40, 42, 44, 46. A first outer panel 86 may extend near the first side 53 of the rail 50 and a second outer panel 87 may extend near the second side 54 of the rail 50, thereby separating an exerciser 11 from bias members 40, 42, 44, 46 and any other mechanisms positioned underneath the rail 50 of the present invention.

In use, an exerciser 11 may easily straddle the singular rail 50 to position herself on the carriage 70. In embodiments utilizing variable resistance, the exerciser 11 may select which of the bias members 40, 42, 44, 46 are to be connected to the carriage 70 via the bias mount 72, and thus adjust the resistance applied as the carriage 70 is drawn away from the first end 21 of the exercise machine 20 by the exerciser 11.

Therefore, those skilled in the art will appreciate the many described functional advantages of an improved exercise machine 20 comprising a singular rail 50 over traditional prior art, including but not limited to the separation of bias members 40, 42, 44, 46 from an exerciser 11 to reduce the potential for exerciser injury, the reduced dimensions of the exercise machine 20 to allow easier access by an exerciser 11 to mount and dismount the exercise machine 20, and the ability to incorporate novel mechanisms to automatically change the resistance level applied to the carriage 70 by the bias members 40, 42, 44, 46.

E. Third Rail Embodiment and Operation Thereo.

Figure 12:
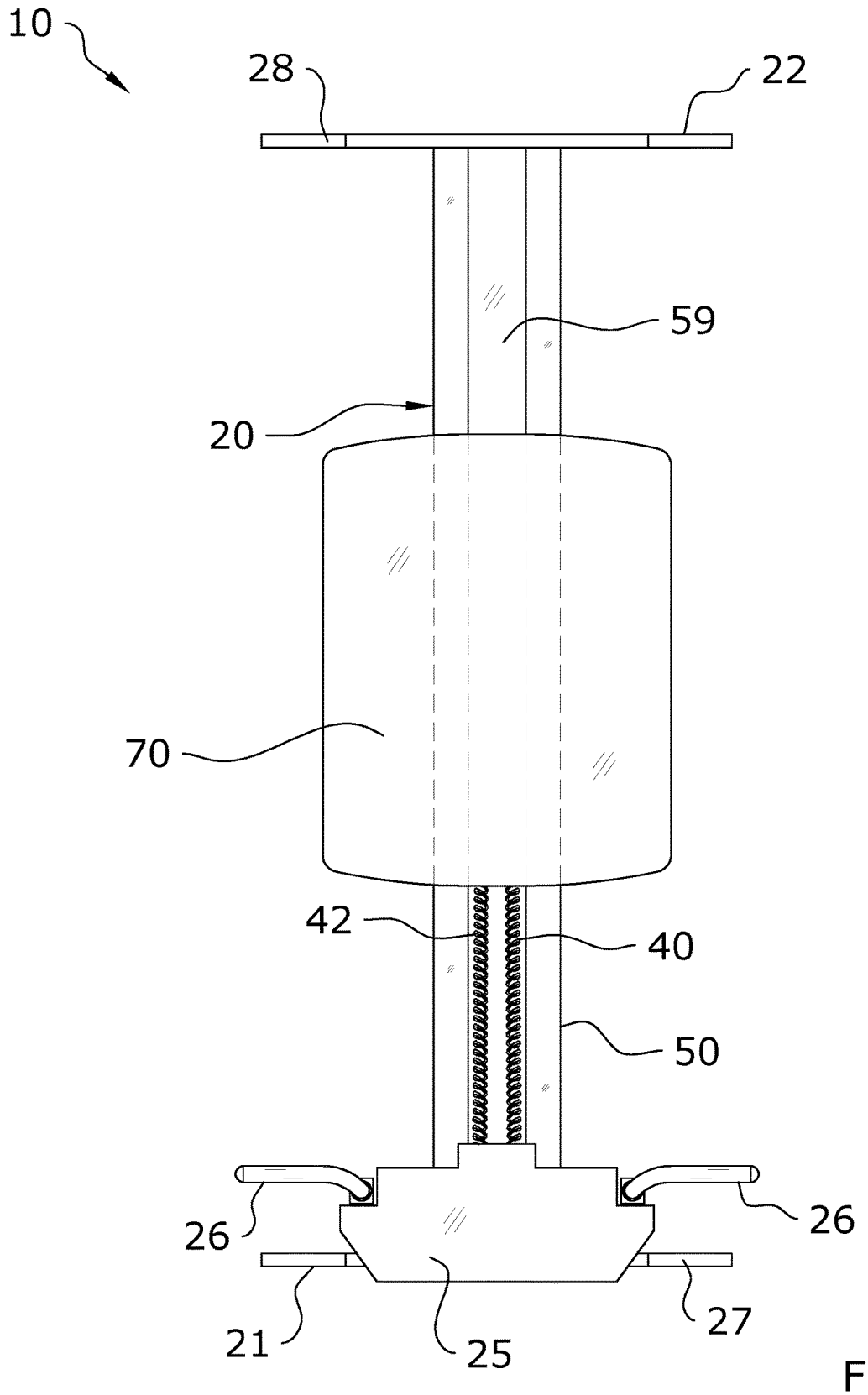
FIG. 12 is a top view of a third embodiment of the present invention.

FIGS. 11-14 illustrate a third embodiment of the present invention which utilizes a single rail 50 which is centrally positioned along the longitudinal axis of the exercise machine 20 and bias members 40, 42, 44, 46 internally to the singular rail 50. The rail 50 extends between the first end 21 and the second end 22 of the exercise machine 20. The rail 50 includes an upper end 51, a lower end 52, a first side 53, and a second side 54. Additionally, in this embodiment, the rail 50 is substantially hollow with an internal channel 60 extending therethrough between its first and second ends 53, 54. The rail 50 may also include an upper slot 59 through which the lower bracket 71 will extend to link the carriage 70 with a bias mount 72 kept internal to the rail 50. In this embodiment of the present invention, the bias members 40, 42, 44, 46 extend through the internal channel 60 of the rail 50 as shown in FIG. 12.

As can be readily seen in the drawings, the internal channel 60 of the rail 50 further provides the safety and injury-preventing advantages of enclosing any one of a multitude of mechanical, electromechanical, dashpot, eddy current brakes or other bias members 40, 42, 44, 46 that may be used on an improved exercise machine 20, thereby preventing accidental contact by and injury of an exerciser 11.

Those skilled in the art will immediately appreciate the significant improvements in structural rigidity of a singular rail 50 comprising a hollow internal channel 60. Further, those skilled in the art will appreciate the cost/benefit of high production manufacturing processes that produce the structural section from glass-reinforced fiber, steel, aluminum, or other materials delivering the desired tensile, and the improved torsional and column bending strength for use on an improved exercise machine 20.

Figure 13:
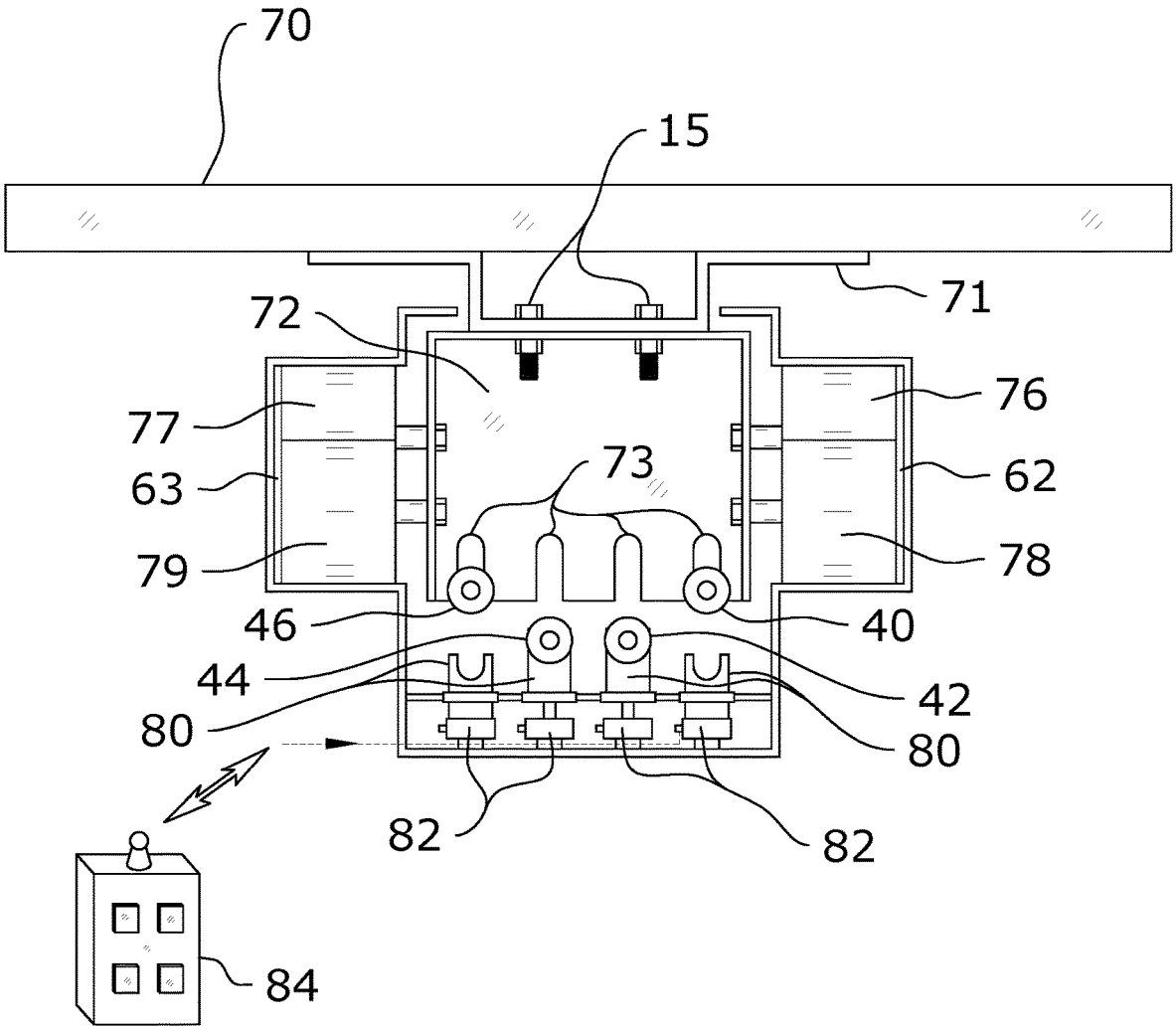
FIG. 13 is a sectional view of the third embodiment of the present invention which includes a system for varying resistance.
Figure 14:
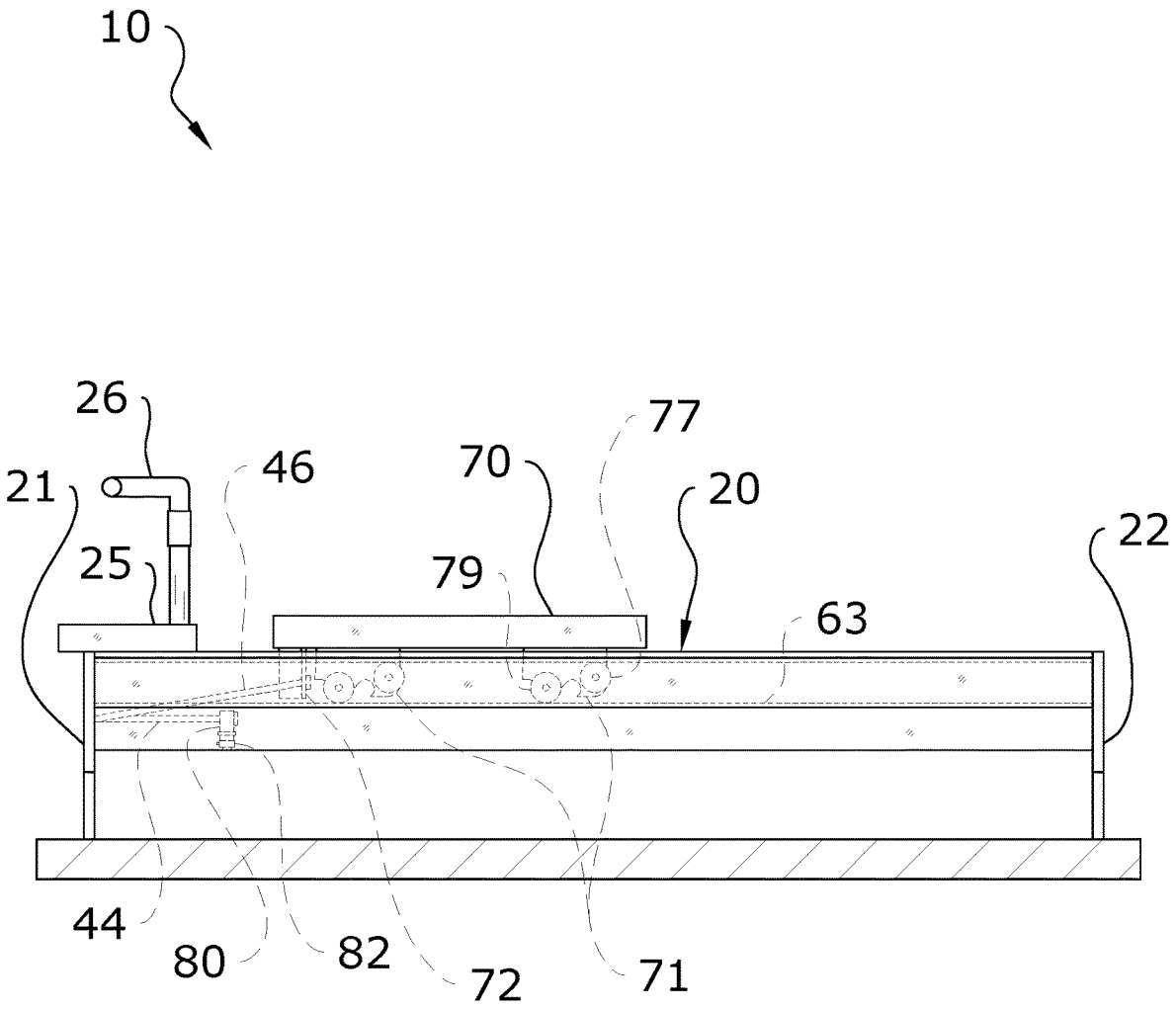
FIG. 14 is a side view of the third embodiment of the present invention which includes a system for varying resistance.
Figure 15:
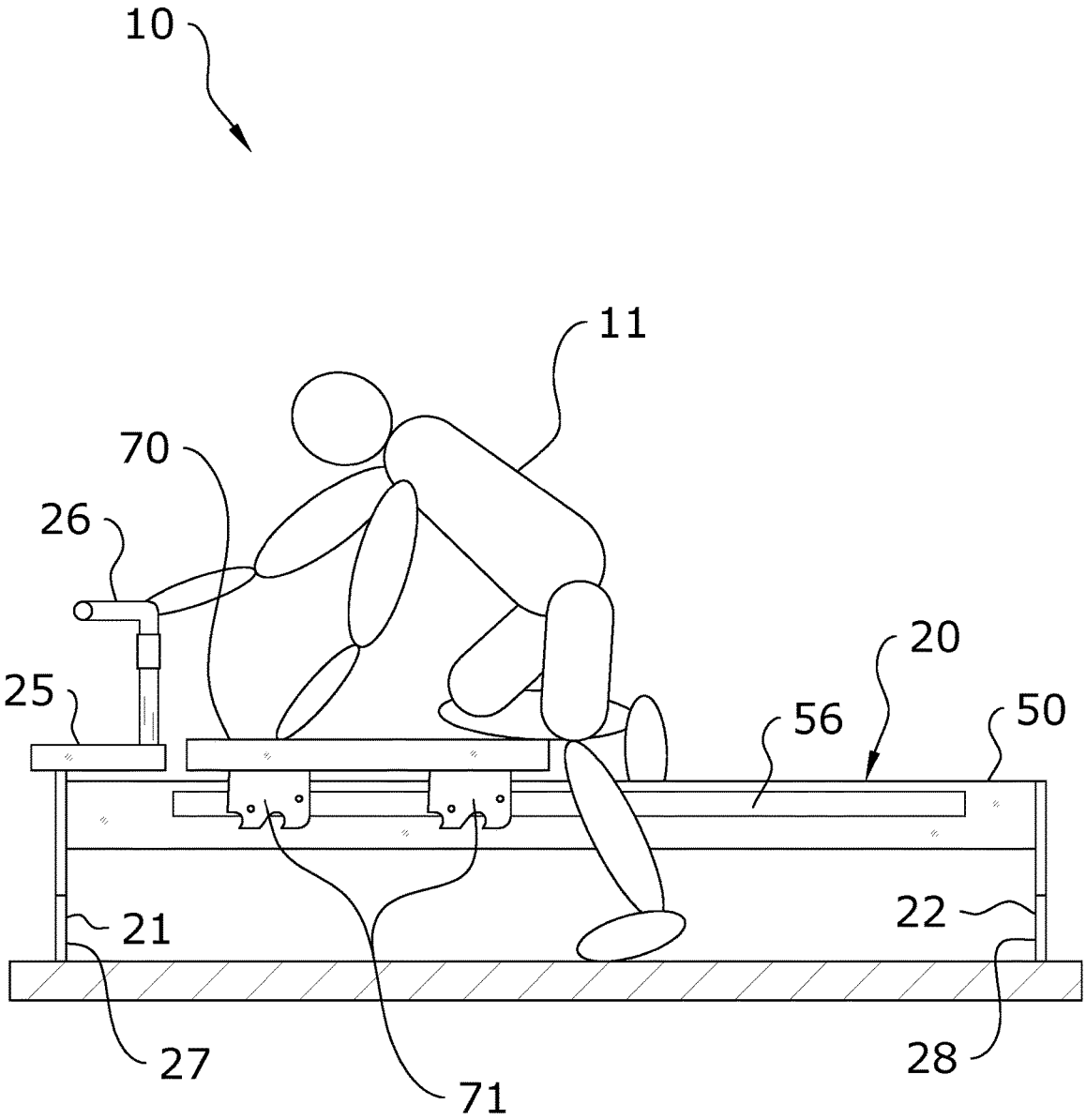
FIG. 15 is a side view of an exemplary embodiment of the present invention which utilizes two supports at either end of the exercise machine.

The rail 50 may comprise various configurations. Preferably, the rail 50 will be substantially hollow so as to define the internal channel 60 extending therethrough. The sides 53, 54 of the rail 50 may include outward projections which form first and second wheel tracks 62, 63 which are internal to the rail 50 as shown in FIG. 13. The first wheels 76, 78 will generally engage within the first wheel track 62, which extends out of the first side 53 of the rail 50. The second wheels 77, 79 will generally engage within the second wheel track 63, which extends out of the second side 54 of the rail 50.

The bias members 40, 42, 44, 46 will extend through the internal channel 60 of the rail 50. Generally, bias members 40, 42, 44, 46 will be connected between the first end 21 of the exercise machine 20 and the carriage 70. As mentioned previously, various types of bias members 40, 42, 44, 46 known in the art to provide resistance in one direction may be used, such as resistance springs and the like. Although the figures illustrate four bias members 40, 42, 44, 46 within the internal channel 60, more or less may be utilized in different embodiments.

FIG. 13 illustrates one possible interconnection between the carriage 70 and the bias members 40, 42, 44, 46 which allows for automatic variation of resistance. A lower bracket 71 extends downwardly from the carriage 70 and extends at least partially into the internal channel 60 through the upper slot 59. A bias mount 72, which is positioned slidably within the internal channel 60, either extends downwardly from or is connected to the lower bracket 71, such as by fasteners 15. The wheels 76, 77, 78, 79 extend outwardly from the bias mount 72 as shown in FIG. 13, with the wheels 76, 77, 78, 79 extending into the respective wheel tracks 62, 63 within the internal channel 60 to engage therewith as discussed previously.

As shown in FIG. 13, the bias mount 72 may include a plurality of receiver slots 73 which are adapted to removably retain the distal ends of selected bias members 40, 42, 44, 46. Bias members 40, 46 which are secured within the receiver slots 73 will impose resistance on the carriage 70 as it is moved away from the first end 21 of the exercise machine 20, while bias members 42, 44 which are not secured within the receiver slots 73 will not impose resistance on the carriage 70. Thus, one may increase the resistance (and thus the intensity of a workout) by securing more of the bias members 40, 42, 44, 46 within the receiver slots 73. Alternatively, one may decrease the resistance by removing more of the bias members 40, 42, 44, 46 from the receiver slots 73.

When an exerciser 11 begins performing an exercise upon the exercise machine 20, they would apply a sufficient force exceeding the K-factor of the two attached bias members 40, 46, in a direction opposed to the first end 21 of the exercise machine 20, thereby moving the carriage 70 in the direction of their exercise force. Also shown in the drawing are two bias members 42, 44 in an idle state, being retained by a mechanical lifter 80 not attached to the carriage 70. The K-factor of the idle bias members 42, 44 remains constant while idle, and do not contribute to the force the exerciser 11 must overcome in order to move the carriage 70 away from the first end 21 of the exercise machine 20.

In one embodiment of the present invention, the bias members 40, 42, 44, 46 may be automatically adjusted between an engaged position and a disengaged position with respect to the receiver slots 73. As shown in FIG. 13, one or more mechanical lifters 80 may be positioned along the bottom of the internal channel 60; preferably at or near the first end 21 of the exercise machine 20. Solenoids 82 positioned underneath the mechanical lifters 80 will cause the mechanical lifters 80 to rise or fall based on user input, such as through a controller 84. Thus, the mechanical lifters 80 may be utilized to lift bias members 40, 42, 44, 46 up into the receiver slots 73 or remove bias members 40, 42, 44, 46 therefrom.

It should be noted that the bias members 40, 42, 44, 46, and the method and device just described for automatically changing the level or exercise resistance within the internal channel 60 are merely presented as one of innumerable examples of methods and devices that may vary the exercise resistance level of an improved exercise machine 20, and are not meant to be limiting.

Those skilled in the art will also appreciate that a great many known and efficient methods exist to allow for the removable attachment of the ends of bias members 40, 42, 44, 46 to a carriage 70. It is therefore not the intention to describe every possible resistance means that may be housed within the internal channel 60, or every possible method of connecting a bias member 40, 42, 44, 46 between a stationary portion of the exercise machine 20 and a carriage 70. To do so would be exhaustive and burdensome, but would nevertheless reinforce the novelty and usefulness of integrating the primary bias members 40, 42, 44, 46 within the rail 50 as described in the present invention.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine, comprising:

a frame having a monorail, wherein the monorail has a first exterior side and a second exterior side opposite of the first exterior side;

a carriage movably connected to the monorail, wherein the carriage includes an upper surface;

a first platform connected to the frame near a first end of the frame;

a first bias member adapted to be connected to the carriage, wherein the first bias member is near the first exterior side of the monorail, wherein the first bias member is not positioned between the first exterior side and the second exterior side of the monorail; and a second bias member adapted to be connected to the carriage, wherein the second bias member is near the second exterior side of the monorail, wherein the second bias member is not positioned between the first exterior side and the second exterior side of the monorail;

wherein the first bias member includes an upper surface and the second bias member includes an upper surface, wherein the upper surface of the first bias member and the upper surface of the second bias member are below the upper surface of the carriage when the first bias member and the second bias member are connected to the carriage.

2. The exercise machine of claim 1, wherein the monorail is comprised of a single rail.

3. The exercise machine of claim 1, wherein the monorail is comprised of an I-beam having a first channel extending along the first exterior side and a second channel extending along the second exterior side, wherein the carriage includes a plurality of first wheels that are positioned within the first channel, and wherein the carriage includes a plurality of second wheels that are positioned within the second channel.

4. The exercise machine of claim 1, wherein the monorail is comprised of a first rail and a second rail, wherein the first rail is in close proximity to the second rail, wherein the first rail is connected to the second rail, and wherein the first rail is parallel with respect to the second rail.

5. The exercise machine of claim 1, wherein the monorail is comprised of a first rail and a second rail, wherein the first rail is in close proximity to the second rail, wherein the first rail is connected to the second rail by a plurality of connectors extending between the first rail and the second rail, and wherein the first rail is parallel with respect to the second rail.

6. The exercise machine of claim 1, wherein the first bias member and the second bias member are each comprised of a spring.

7. The exercise machine of claim 1, wherein the first bias member and the second bias member are each connected to the frame.

8. The exercise machine of claim 1, further comprising a second platform connected to the frame near a second end of the frame.

9. The exercise machine of claim 1, wherein the upper surface of the first bias member and the upper surface of the second bias member are below an upper surface of the monorail when the first bias member and the second bias member are connected to the carriage.

10. The exercise machine of claim 1, wherein the upper surface of the first bias member and the upper surface of the second bias member are near a plane that intersects an upper surface of the monorail when the first bias member and the second bias member are connected to the carriage.

11. The exercise machine of claim 1, wherein the first bias member extends alongside the first exterior side of the monorail, and wherein the second bias member extends alongside the second exterior side of the monorail.

12. The exercise machine of claim 1, further comprising a third bias member adapted to be connected to the carriage and a fourth bias member adapted to be connected to the carriage, wherein the first bias member extends alongside the first exterior side of the monorail, wherein the second bias member extends alongside the second exterior side of the monorail, wherein the third bias member extends alongside the first bias member, wherein the fourth bias member extends alongside the second bias member, wherein the third bias member is further away from the first exterior side of the monorail than the first bias member, and wherein the fourth bias member is further away from the second exterior side of the monorail than the second bias member.

13. The exercise machine of claim 12, wherein the upper surface of the first bias member, the upper surface of the second bias member, the upper surface of the third bias member and the upper surface of the fourth bias member are below an upper surface of the monorail when the first bias member, the second bias member, the third bias member and the fourth bias member are connected to the carriage.

14. An exercise machine, comprising:

a frame having a monorail, wherein the monorail has a first exterior side and a second exterior side opposite of the first exterior side;

a carriage movably connected to the monorail, wherein the carriage includes an upper surface;

a first platform connected to the frame near a first end of the frame;

a first bias member adapted to be connected to the carriage, wherein the first bias member is near or distally spaced with respect to the first exterior side of the monorail, wherein the first bias member is not positioned between the first exterior side and the second exterior side of the monorail; and a second bias member adapted to be connected to the carriage, wherein the second bias member is near or distally spaced with respect to the second exterior side of the monorail, wherein the second bias member is not positioned between the first exterior side and the second exterior side of the monorail;

wherein the first bias member includes an upper surface and the second bias member includes an upper surface, wherein the upper surface of the first bias member and the upper surface of the second bias member are below an upper surface of the monorail when the first bias member and the second bias member are connected to the carriage.

15. The exercise machine of claim 14, wherein the monorail is comprised of a single rail.

16. The exercise machine of claim 14, wherein the monorail is comprised of an I-beam having a first channel extending along the first exterior side and a second channel extending along the second exterior side, wherein the carriage includes a plurality of first wheels that are positioned within the first channel, and wherein the carriage includes a plurality of second wheels that are positioned within the second channel.

17. The exercise machine of claim 14, wherein the monorail is comprised of a first rail and a second rail, wherein the first rail is in close proximity to the second rail, wherein the first rail is connected to the second rail, and wherein the first rail is parallel with respect to the second rail.

18. The exercise machine of claim 14, wherein the monorail is comprised of a first rail and a second rail, wherein the first rail is in close proximity to the second rail, wherein the first rail is connected to the second rail by a plurality of connectors extending between the first rail and the second rail, and wherein the first rail is parallel with respect to the second rail.

19. The exercise machine of claim 14, wherein the first bias member and the second bias member are each comprised of a spring.

20. The exercise machine of claim 14, wherein the first bias member and the second bias member are each connected to the frame.

21. The exercise machine of claim 14, further comprising a second platform connected to the frame near a second end of the frame.

22. The exercise machine of claim 14, wherein the upper surface of the first bias member and the upper surface of the second bias member are below the upper surface of the monorail when the first bias member and the second bias member are connected to the carriage.

23. The exercise machine of claim 14, wherein the upper surface of the first bias member and the upper surface of the second bias member are near a plane that intersects the upper surface of the monorail when the first bias member and the second bias member are connected to the carriage.

24. The exercise machine of claim 14, wherein the first bias member extends alongside the first exterior side of the monorail, and wherein the second bias member extends alongside the second exterior side of the monorail.

25. The exercise machine of claim 14, further comprising a third bias member adapted to be connected to the carriage and a fourth bias member adapted to be connected to the carriage, wherein the first bias member extends alongside the first exterior side of the monorail, wherein the second bias member extends alongside the second exterior side of the monorail, wherein the third bias member extends alongside the first bias member, wherein the fourth bias member extends alongside the second bias member, wherein the third bias member is further away from the first exterior side of the monorail than the first bias member, and wherein the fourth bias member is further away from the second exterior side of the monorail than the second bias member.

26. The exercise machine of claim 25, wherein the upper surface of the first bias member, the upper surface of the second bias member, the upper surface of the third bias member and the upper surface of the fourth bias member are below the upper surface of the monorail when the first bias member, the second bias member, the third bias member and the fourth bias member are connected to the carriage.

27. An exercise machine, comprising:

a monorail having a first end, a second end, a first exterior side, and a second exterior side, wherein the monorail is comprised of an I-beam having a first channel extending along the first exterior side and a second channel extending along the second exterior side;

a first support connected to the monorail and a second support connected to the monorail, wherein the first support and the second support are adapted to contact a ground surface, and wherein the first support and the second support each extend crosswise with respect to the monorail;

a carriage movably connected to the monorail, wherein the carriage includes a plurality of first wheels that are positioned within the first channel, and wherein the carriage includes a plurality of second wheels that are positioned within the second channel;

a first platform connected to the monorail near the first end of the monorail;

a first bias member adapted to be connected to the carriage, wherein the first bias member is near or distally spaced with respect to the first exterior side of the monorail, and wherein the first bias member is parallel with respect to the first exterior side of the monorail; and a second bias member adapted to be connected to the carriage, wherein the second bias member is near or distally spaced with respect to the second exterior side of the monorail, and wherein the second bias member is parallel with respect to the second exterior side of the monorail;

wherein the first bias member includes an upper surface and the second bias member includes an upper surface, wherein the upper surface of the first bias member and the upper surface of the second bias member are below an upper surface of the carriage when the first bias member and the second bias member are connected to the carriage.

28. The exercise machine of claim 27, wherein the upper surface of the first bias member and the upper surface of the second bias member are below an upper surface of the monorail when the first bias member and the second bias member are connected to the carriage.

29. The exercise machine of claim 28, wherein the upper surface of the first bias member and the upper surface of the second bias member are near a first plane with respect to the upper surface of the monorail when the first bias member and the second bias member are connected to the carriage.

30. The exercise machine of claim 29, wherein the first bias member extends alongside the first exterior side of the monorail, wherein the second bias member extends alongside the second exterior side of the monorail, wherein the upper surface of the first bias member and the upper surface of the second bias member are on a second plane, and wherein the first bias member and the second bias member are parallel to one another.

* * * * *